US008986468B2

(12) United States Patent
Miura et al.

(10) Patent No.: US 8,986,468 B2
(45) Date of Patent: Mar. 24, 2015

(54) HIGH-STRENGTH COLD-ROLLED STEEL SHEET EXCELLENT IN COATING ADHESION, WORKABILITY AND HYDROGEN EMBRITTLEMENT RESISTANCE, AND STEEL COMPONENT FOR AUTOMOBILE

(75) Inventors: Masaaki Miura, Kakogawa (JP); Shinji Kozuma, Kakogawa (JP); Yoichi Mukai, Kakogawa (JP); Yoshinobu Omiya, Kakogawa (JP)

(73) Assignee: Kobe Steel, Ltd., Kobe-shi (JP)

( * ) Notice: Subject to any disclaimer, the term of this patent is extended or adjusted under 35 U.S.C. 154(b) by 0 days.

(21) Appl. No.: 11/908,616

(22) PCT Filed: Mar. 23, 2006

(86) PCT No.: PCT/JP2006/305825

§ 371 (c)(1),
(2), (4) Date: Sep. 14, 2007

(87) PCT Pub. No.: WO2006/109489

PCT Pub. Date: Oct. 19, 2006

(65) Prior Publication Data

US 2009/0053096 A1 Feb. 26, 2009

(30) Foreign Application Priority Data

Mar. 31, 2005 (JP) ..... 2005-104850
Mar. 31, 2005 (JP) ..... 2005-104851

(51) Int. Cl.
*C22C 38/00* (2006.01)
*C21D 8/04* (2006.01)

(Continued)

(52) U.S. Cl.
CPC ..... *C22C 38/02* (2013.01); *C21D 8/0468* (2013.01); *C21D 9/46* (2013.01); *C21D 9/48* (2013.01);

(Continued)

(58) Field of Classification Search
CPC ..... C21D 8/0468; C21D 9/46; C21D 9/48; C22C 38/02
USPC ..... 148/320; 420/103, 117
IPC ..... C22C 38/00, 38/02, 38/06
See application file for complete search history.

(56) References Cited

U.S. PATENT DOCUMENTS 4,775,599 A * 10/1988 Matsuoka et al. ..... 428/600
5,578,143 A 11/1996 Koyama et al.

(Continued)

FOREIGN PATENT DOCUMENTS

CN 1547620 A 11/2004
EP 1207213 A1 * 5/2002 ..... C22C 38/00

(Continued)

OTHER PUBLICATIONS

U.S. Appl. No. 12/162,878, filed Jul. 31, 2008, Mukai et al.

(Continued)

*Primary Examiner* — Kaj K Olsen
*Assistant Examiner* — Alexander Polyansky
(74) *Attorney, Agent, or Firm* — Oblon, McClelland, Maier & Neustadt, L.L.P.

(57) ABSTRACT

A cold rolled steel sheet satisfying on the basis of percent by mass the chemical composition of 0.06-0.6% C, 0.1-2% Si, 0.01-3% Al, 1-4% Si+Al, 1-6% Mn, Si/Mn≤0.40, in which there exists 10 or more pieces/100 $\mu m^2$ of Mn—Si composite oxide having Mn—Si atom ratio (Mn/Si) of 0.5 or over and major axis of from 0.01 μm to 5 μm and also having a covering ratio of 10% or below at which the surface of the steel sheet is covered with oxide containing Si as the main component.

29 Claims, 5 Drawing Sheets

(51) Int. Cl.

| | |
|---|---|
| ***C21D 9/46*** | (2006.01) |
| ***C21D 9/48*** | (2006.01) |
| ***C22C 38/04*** | (2006.01) |
| *C22C 38/02* | (2006.01) |
| *C22C 38/06* | (2006.01) |

(52) U.S. Cl.

CPC ..... *C22C 38/04* (2013.01); *C22C 38/06* (2013.01); *C21D 2211/004* (2013.01); *C21D 2211/005* (2013.01); *C21D 2211/008* (2013.01)

USPC ..... 148/320; 420/103; 420/117

(56) References Cited

U.S. PATENT DOCUMENTS

| | | | | |
|---|---|---|---|---|
| 2002/0160221 | A1 | 10/2002 | Takeda et al. | |
| 2003/0084966 | A1* | 5/2003 | Ikeda et al. | 148/320 |
| 2004/0074575 | A1* | 4/2004 | Kashima et al. | 148/653 |
| 2004/0234807 | A1* | 11/2004 | Suzuki et al. | 428/659 |
| 2004/0238081 | A1 | 12/2004 | Yoshinaga et al. | |
| 2005/0081966 | A1 | 4/2005 | Kashima et al. | |
| 2005/0139293 | A1* | 6/2005 | Nomura et al. | 148/320 |
| 2005/0150580 | A1 | 7/2005 | Akamizu et al. | |
| 2005/0247378 | A1 | 11/2005 | Ikeda et al. | |
| 2007/0138138 | A1* | 6/2007 | Hayashida et al. | 216/83 |
| 2008/0166257 | A1 | 7/2008 | Yoshinaga et al. | |
| 2008/0295924 | A1 | 12/2008 | Yoshinaga et al. | |
| 2008/0308200 | A1 | 12/2008 | Yoshinaga et al. | |
| 2010/0092332 | A1 | 4/2010 | Ikeda et al. | |

FOREIGN PATENT DOCUMENTS

| | | | | |
|---|---|---|---|---|
| EP | 1 391 526 | A2 | 2/2004 | |
| EP | 1 512 760 | A2 | 3/2005 | |
| EP | 1 548 142 | A1 | 6/2005 | |
| EP | 1 553 202 | A1 | 7/2005 | |
| EP | 1 589 126 | A1 | 10/2005 | |
| JP | 4-276060 | | 10/1992 | |
| JP | 4 276060 | | 10/1992 | |
| JP | 5 78752 | | 3/1993 | |
| JP | 5 117761 | | 5/1993 | |
| JP | 2951480 | | 7/1999 | |
| JP | 3049147 | | 3/2000 | |
| JP | 3266328 | | 1/2002 | |
| JP | 2002 129241 | | 5/2002 | |
| JP | 2002-129285 | A | 5/2002 | |
| JP | 2002 235160 | | 8/2002 | |
| JP | 2002-322551 | | 11/2002 | |
| JP | 2003-096541 | A | 4/2003 | |
| JP | 2003-147486 | | 5/2003 | |
| JP | 2003 171736 | | 6/2003 | |
| JP | 2003 193193 | | 7/2003 | |
| JP | 2003 201538 | | 7/2003 | |
| JP | 2003-201538 | | 7/2003 | |
| JP | 2004 238679 | | 8/2004 | |
| JP | 2004 308002 | | 11/2004 | |
| JP | 2004-323969 | | 11/2004 | |
| JP | 2005281787 | * | 10/2005 | C22C 38/00 |
| KR | 10-0188551 | | 1/1999 | |

OTHER PUBLICATIONS

U.S. Appl. No. 12/303,566, filed Dec. 5, 2008, Nakaya, et al.
U.S. Appl. No. 12/303,634, filed Dec. 5, 2008, Nakaya, et al.
U.S. Appl. No. 12/305,998, filed Dec. 22, 2008, Saito, et al.
Chinese Office Action Issued Jul. 4, 2012 in Patent Application No. 200680004864.4 (with English translation).
Search Report received Sep. 22, 2014, in European Patent Application No. 13182531.7, filed Aug. 30, 2013.
Extended European Search Report issued Nov. 8, 2013 in Patent Application No. 13182532.5.
Partial European Search Report issued Nov. 8, 2013 in Patent Application No. 13182531.7.
Extended European Search Report issued Nov. 8, 2013 in Patent Application No. 13182530.9.
Koh-ichi Sugimoto, et al., "Ductility and Formability of Newly Developed High Strength Low Alloy TRIP-aided Sheet Steels with Annealed Martensite Matrix" ISIJ International, vol. 42, No. 8, XP001182009, 2002, pp. 910-915.
I.B. Timokhina, et al., "Effect of Deformation Schedule on the Microstructure and Mechanical Properties of a Thermomechanically Processed C-Mn-Si Transformation-Induced Plasticity Steel" Metallurgical and Materials Transactions A, vol. 34A, No. 8, XP019694562. Aug. 1, 2003 pp. 1599-1609.
H-B Ryu, et al., "Effect of Thermomechanical Processing on the Retained Austenite Content in a Si-Mn Transformation-Induced-Plasticity Steel" Metallurgical and Materials Transactions A, vol. 33A, No. 9, XP019694104, Sep. 1, 2002, pp. 2811-2816.
Koh-ichi Sugimoto, et al. "Retained Austenite Characteristics and Tensile Properties in a TRIP Type Bainitic Sheet Steel" ISIJ International, vol. 40, No. 9, XP009048166, Jan. 1, 2000, pp. 902-908.

* cited by examiner

HIGH-STRENGTH COLD-ROLLED STEEL SHEET EXCELLENT IN COATING ADHESION, WORKABILITY AND HYDROGEN EMBRITTLEMENT RESISTANCE, AND STEEL COMPONENT FOR AUTOMOBILE

TECHNICAL FIELD

The present invention relates to high-strength cold-rolled steel sheets and automobile components of steel having excellent properties in film adhesion, workability, and hydrogen embrittlement resistivity, and in particular, to cold-rolled steel sheets (retained-austenite-containing steel sheets) having excellent workability with a tensile strength higher than 780 MPa, superior hydrogen embrittlement resistivity, and the best fitness to the manufacture of automobile steel components, and to automobile steel components having a high tensile strength and an excellent resistance to hydrogen embrittlement obtainable from the use of the aforesaid steel sheets.

BACKGROUND ART

Higher strength of steel material is much demanded in an environment marked by the call for improvement of automobile fuel economy and trimming of weight, and in the field of cold-rolled steel sheets, the tendency toward high-tensile strength steel sheets (hardness enhancement) is advancing. On the other hand, cold-rolled steel sheets are press-formed in the course of manufacturing components, but this can be possible on the premise that the steel sheets retain sufficient ductility such as elongation. While addition of alloy elements is effective for enhancement of strength, ductility tends to decrease as the added quantity of the alloy element increases.

Among the alloy elements as abovementioned, Si is an element that causes relatively small decrease in elongation and, therefore, is useful for achieving enhancement of strength while maintaining elongation. Increase in Si content, however, causes degradation in chemical conversion treatability resulting in inferior film adhesion after coating. For this reason, when the chemical conversion treatability was given more importance, the Si content was obliged to be decreased. Also, the cracks attributable to Si-containing grain-boundary oxide formed on the surface of the steel sheet in case the Si content increased became a factor in deterioration of coated film adhesion.

As the technology hitherto used to satisfy both of mechanical properties and chemical conversion treatability, there is a technique by which the steel sheet is covered in the surface with a clad member, thereby providing a low-density Si layer in the surface for high chemical conversion treatability and securing mechanical properties with a high-density Si layer on the inside (e.g., the patent document 1). The necessity of adopting a clad structure, however, entails the problem that the manufacturing process becomes complex resulting in increased manufacturing cost.

There is also another conventional technique in which a special alloy element is added to prevent Si, the harmful factor against chemical conversion treatability, from becoming concentrated in the surface (e.g., the patent documents 2 and 3). In this method, addition of Ni or Cu suppresses concentration of Si in the surface layer of the steel sheet securing chemical conversion treatability. However, this method has a problem in that the use of expensive Ni or Cu pushes up the cost.

The steel material used by these methods has a low C-content as below 0.005% and it relates to the so-called IF steel intended for enhanced deep drawing quality by controlling texture at a specific recrystallization temperature. With such IF steel sheets containing very low C-content, it is difficult to attain the level of high tensile strength as intended by the present invention.

The patent document 4 describes a case where the chemical conversion treatability is secured by using precipitated NbC as crystal nucleation sites for crystallization of zinc phosphate. This technique is also to secure the deep drawing quality by controlling texture in the low C-content region below 0.02%, but it is undeniable the steel sheet thus obtainable shows insufficiency in strength even though its C-content is somewhat higher than the above IF steels.

The patent document 5 proposes a retained-austenite containing steel sheet which secures chemical conversion treatability with a defined ratio of $SiO_2/Mn_2SiO_4$ in the surface layer. Since this technique needs to control formation of oxide in the surface layer and elemental ratio of Si/Fe, it is necessary either to remove the Si oxide formed on the surface after continuous annealing by means of acid pickling or brushing, or to suppress the forming volume of Si oxide by regulating the dewpoint at over −30° C. at a temperature above Ac-1 transformation point.

However, the treatment by acid pickling or brushing requires increased manufacturing steps incurring a rise in manufacturing cost. Also, as far as the embodiment shown in the document indicates, even if the dew point control which is carried out inside the continuous annealing furnace is exercised, the best available result will be about 1.0 for the ratio of $SiO_2/Mn_2SiO_4$ in the uppermost layer, and further, the chemical conversion treatability cannot be said to have been sufficiently improved inasmuch as $SiO_2$ that will disturb formation of chemical conversion film crystal will be produced in an amount roughly equal to $Mn_2SiO_4$.

The patent document 6 proposes the technique that by observing the surface of the steel sheet with XPS (X-ray photoelectron spectroscopy), the ratio of Si, from which oxide is composed, against Mn (Si/Mn) should be constricted below 1 thereby enhancing the chemical conversion treatability.

It is a common knowledge that the steel having Si/Mn ratio of 1 or below, such as the mild steel in which the Si content is almost zero or the steel sheet having a Si content of 0.1% or below, has a good chemical conversion treatability. However, as above-mentioned, it is necessary that the steel sheet should have a certain extent of Si content in order to improve both strength and ductility, and yet there is a limitation in decreasing Si content to make Si/Mn ratio 1 or below. Even if Si/Mn ratio could be kept 1 or be low by controlling Mn quantity to an appropriate level while securing proper amount of Si, it would not necessarily ensure that a steel sheet provided with good chemical conversion treatability could be stably obtained.

Incidentally, known as a steel sheet that can enhance both strength and ductility at a time is the retained austenite steel; retained austenite (γR) produced in its constitution causes induced transformation (strain induced transformation or TRIP=transformation induced plasticity) during work deformation and thereby enhances ductility. As commonly used methods to keep such retained austenite subsisting stably under room temperature, there are two methods; one is to make it contain about 1-2% of Si, and the other is to make it contain about 1-2% of Al in place of Si.

The above method of making Si positively contained can enhance both strength and ductility at a time, but the method is apt to form Si-based oxidative film on the surface of the steel sheet, because of which the chemical conversion treatability of the sheet becomes inferior. On the other hand, the method of making Al positively contained can yield a steel sheet of comparatively good chemical conversion treatability, but in point of strength and ductility, this steel sheet is inferior to the aforesaid Si-containing steel sheet. Since Al is not an element having intensifying functionality, addition of C, Mn, and other elements of intensifying power in lavish doses is necessary in order to obtain enhanced strength, even though such measure again entails deterioration in weldability, etc.

From the viewpoint of improving mechanical properties, it is also proposed to positively add both Si and Al in the retained austenite steel sheet (e.g., the patent document 7). Still another proposal suggests a steel sheet in which improvement is made of stretch flangeability, in which performance the retained austenite containing steel sheet has shortcomings (e.g., the patent document 8). These steel sheets are also apt to form Si-based oxidative film on the surface owing to lavishly added Si and are thus perceived to be subject to inferior performance in point of the chemical conversion treatability of the sheet. These sheets are neither improved with respect to hydrogen embrittlement resistivity which is commonly regarded as a drawback of the retained austenite steel sheet.

[Patent Document 1] JP-A-5-78752
[Patent Document 2] Japanese Patent No. 2951480
[Patent Document 3] Japanese Patent No. 3266328
[Patent Document 4] Japanese Patent No. 3049147
[Patent Document 5] JP-A-2003-201538
[Patent Document 6] JP-A-4-276060
[Patent Document 7] JP-A-5-117761
[Patent Document 8] JP-A-2004-238679

DISCLOSURE OF THE INVENTION

Problems to be Solved by the Invention

The present invention has been made in consideration of the above-mentioned circumstances, and the object of this invention is to provide cold-rolled steel sheets having good coating film adhesion, excellent workability (ductility) with a tensile strength of over 780 MPa, and strong resistance to hydrogen embrittlement, and also automobile steel components made of such steel sheets as aforesaid.

Means for Solving the Problems

The high-strength cold-rolled steel sheets according to the present invention should satisfy on the basis of percent by mass (the same basis applies also to the chemical composition appearing hereinafter) the chemical composition of:

C ranging from 0.06 to 0.6%,
Si ranging from 0.1-2%,
Al ranging from 0.01-3%,
Si+Al ranging from 1-4%,
Mn ranging from 1-6%, and
Si/Mn≤0.40;

the above steel sheets containing the following metal structure on the basis of space factor (the same basis applies also to the metal structure appearing hereinafter):

75% or over combined volume of bainitic ferrite and polygonal ferrite,
40% or over bainitic ferrite,
1-50% polygonal ferrite, and
3% or over retained austenite;

also, having a tensile strength of 780 MPa or over; and further, being conditional on the following:

(I) The above steel sheets are characterized in that on the surface of the steel sheet (when viewed as plane), there exist 10 pieces/100 $\mu m^2$ or more of Mn—Si composite oxide with Mn—Si atom ratio of 0.5 or more and having a major axis of from 0.01 μm to 5 μm, and the oxides containing Si as the main component cover the surface of the steel sheet at a covering rate of 10% or less. (Hereinafter the above steel sheet may be referred to as "the invention-related steel sheet 1.")

The above oxide containing Si as the main component means the oxide which contains Si at an atom ratio of more than 67% in all the component elements except oxygen of the oxide. By analysis, such oxide has been proved to be an amorphous substance.

As shown by an embodiment described later, the steel sheet surface covering ratio for an oxide containing Si as the main component is obtained by preparing a sample by abstraction replica method, observing the sample by TEM (Transmission Electron Microscope), and analyzing the observation result by EDX (Energy Dispersive X-ray) analysis for mapping and quantitative analysis of Si, O (oxygen), Mn, and Fe; and the data available from the precedent analysis may be used for further analysis by the image analysis. If the TEM observation of the abstraction replica is too troublesome, it may well be exercised instead to do surface mapping of Si, O, Mn, and Fe by means of AES (Auger Electron Spectroscopy) at 2000× to 5000× magnification and use the data therefrom for image analysis. (The foregoing applies to relevant parts hereinafter.)

Other steel sheets according to the present invention after the above problems have been solved satisfy the chemical composition of:

C ranging from 0.06 to 0.6%,
Si ranging from 0.1 to 2%,
Al ranging from 0.01 to 3%,
Si+Al ranging from 1 to 4%, and
Mn ranging from 1 to 6%;

the above steel sheets having the metal structure containing:

75% or over combined volume of bainitic ferrite and polygonal ferrite,
40% or over bainitic ferrite,
1-50% polygonal ferrite, and
3% or over retained austenite;

also, having a tensile strength of 780 MPa or over; and further, being conditional on the following:

(II) The above steel sheets are characterized in that when SEM (Scanning Electron Microscope) is used to observe the cross section in the proximity of the surface of the steel sheet at 2000× magnification, there exists no crack which is 3 μm or less in width and 5 μm or more in depth in any ten fields of view. (Hereinafter the above steel sheet may be referred to as "the invention-related steel sheet 2.")

Still other steel sheets according to the present invention after the above problems have been solved are characterized in that the steel sheets satisfy the chemical composition of:

C ranging from 0.06 to 0.6%,
Si ranging from 0.1 to 2%,
Al ranging from 0.01 to 3%,
Si+Al ranging from 1 to 4%,
Mn ranging from 1 to 6%, and
Si/Mn≤0.40;

that the above steel sheets have the metal structure containing:

75% or over combined volume of bainitic ferrite and polygonal ferrite,
40% or over bainitic ferrite,
1-50% polygonal ferrite, and
3% or over retained austenite;

and further that the above steel sheets have a tensile strength of 780 MPa or over and satisfy the above requirements (I) and (II). (Hereinafter the above steel sheet may be referred to as "the invention-related steel sheet 3.")

The high-strength cold-rolled steel sheets according to the present invention satisfy on the basis of percent by mass (the same basis applies also to the chemical composition appearing hereinafter) the chemical composition of:

C ranging from 0.06 to 0.6%,
Si ranging from 0.1-2%,
Al ranging from 0.01-3%,
Si+Al ranging from 1-4%,
Mn ranging from 1-6%, and
Si/Mn≤0.40;

the above steel sheets having the metal structure containing on the basis of space factor (the same basis applies also to the metal structure appearing hereinafter):

75% or over combined volume of tempered martensite and ferrite,
50% or over tempered martensite,
4-40% ferrite, and
3% and over retained austenite;

also, having a tensile strength of 780 MPa or over; and further, being conditional on the following:

(I) The above steel sheets are characterized in that on the surface of the steel sheet (viewed as plane), there exist 10 pieces/100 $\mu m^2$ or more of Mn—Si composite oxide with Mn—Si atom ratio of 0.5 or more and having a major axis of 0.01 μm or above thru 5 μm or below, and the oxides containing Si as the main component cover the surface of the steel sheet at a rate of 10% or less. (Hereinafter the above steel sheet may be referred to as "the invention-related steel sheet 4.")

Still other steel sheets according to the present invention after the above problems have been solved are characterized in that the steel sheets satisfy the chemical composition of:

C ranging from 0.06 to 0.6%,
Si ranging from 0.1 to 2%,
Al ranging from 0.01 to 3%,
Si+Al ranging from 1 to 4%, and
Mn ranging from 1 to 6%;

the above steel sheets having the metal structure containing:

75% or over combined volume of tempered martensite and ferrite,
50% or over tempered martensite,
4-40% ferrite, and
3% and over retained austenite;

also, having a tensile strength of 780 MPa or over; and further, being conditional on the following:

(II) The above steel sheets are characterized in that when SEM (Scanning Electron Microscope) is used to observe the cross section in the proximity of the surface of the steel sheet at 2000× magnification, there exists no crack which is 3 μm or less in width and 5 μm or more in depth in any ten fields of view. (Hereinafter the above steel sheet may be referred to as "the invention-related steel sheet 5.")

Still other steel sheets according to the present invention after the above problems have been solved are characterized in that the steel sheets satisfy the chemical composition of:

C ranging from 0.06 to 0.6%,
Si ranging from 0.1 to 2%,
Al ranging from 0.01 to 3%,
Si+Al ranging from 1 to 4%,
Mn ranging from 1 to 6%, and
Si/Mn≤0.40;

that the above steel sheets have the metal structure containing:

75% or over combined volume of tempered martensite and ferrite,
tempered martensite: 50% or over,
4-40% ferrite, and
3% and over retained austenite;

and further that the above steel sheets have a tensile strength of 780 MPa or over and satisfy the above requirements (I) and (II). (Hereinafter the above steel sheet may be referred to as "the invention-related steel sheet 6.")

The present invention also includes automobile steel components obtainable by using any of the abovementioned steel sheets as material.

Effect of the Invention

Taking advantage of the present invention, it is possible to realize production of a steel sheet most suitable for the manufacture f automobile steel components having excellent coating film adhesion, excellent workability (ductility) with a tensile strength of 780 MPa and above, and resistance to hydrogen embrittlement, in a most efficient manner without needing to compose cladding or to add expensive elements. The automobile steel components made of the above steel sheets can demonstrate excellent resistance to hydrogen embrittlement in the high strength region of 780 MPa or higher.

BEST MODE FOR CARRYING OUT THE INVENTION

Various studies were made by the inventors of the present invention for the purpose of creating such steel sheets as above-mentioned. Particularly, in order to secure excellent coating film adhesion, the inventors have found that it will do if the below-mentioned requirements (I) and/or (II) can be satisfied, which has led the inventors to arrive at making the present invention. Besides satisfying these requirements, further studies were continued with regard to chemical composition, metal structure, and manufacturing conditions in search for securement of excellent workability (ductility) and hydrogen-embrittlement resistivity under a high tensile strength of 780 MPa or over.

(I) In the surface of a steel sheet (when viewed as plane):

(i) there should exist 10 or more pieces/100 $\mu m^2$ of Mn—Si composite oxide having Mn—Si atom ratio of 0.5 or more and having a major axis of from 0.01 μm to 5 μm; and (ii) the oxide containing Si as the main component (meaning an oxide which contains Si at an atom ratio of more than 67% in all the component elements except oxygen) covers the surface of the steel sheet at a proportion of 10% or less.

(II) When observation by SEM is made of a cross section in the proximity of the surface of the steel sheet at 2000× magnification, there should not exist any crack which is 3 μm or below in width and 5 μm or above in depth, in any 10 fields of view.

The reasons why the above requirements (I) and (II) are set forth are described in detail below.

<In the surface of a steel sheet, there should exist 10 or more pieces/100 $\mu m^2$ of Mn—Si composite oxide having Mn—Si atom ratio of 0.5 or more and having a major axis of 0.01 μm thru 5 μm.>

The inventors of the present invention have long been engaged in the research for creation of a high-strength steel sheet having excellent coating film adhesion and had already made a proposal on the chemical conversion treatability enhancement technique for steel sheets with relatively high Si content (Japanese Patent Application No. 2003-106152). This technique is intended to enhance the chemical conversion treatability by finely dispersing amorphous Si oxide which otherwise would adversely affect the chemical conversion treatability. However, in the region where Si concentration is relatively low, not amorphous Si oxide but Mn—Si composite oxide is formed as the major oxide. It is conceived that this composite oxide also deteriorates coating film adhesion as in the case of amorphous Si oxide. Our idea was to seek for any positive use of the Mn—Si composite oxide for enhancing the chemical conversion treatability, and our research has been continued on along that line of idea.

As a result, we have succeeded in enhancing the chemical conversion treatability by dispersing the Mn—Si composite oxide in a very fine form in the gathering of iron-based oxide produced in the surface layer of the steel sheet and, as further described later, by forming an "electrochemically inhomogeneous field in the oxide interface" which functions as a nucleation site for zinc phosphate crystal. Why the Mn—Si composite oxide defined in the present invention is effective to help create the zinc phosphate crystal is unclear but can be assumed as follows.

It is commonly known that in the chemical conversion process, zinc phosphate crystal can be produced rather easily in an "electrochemically inhomogeneous field" as formed in the crystal grain boundary or in the vicinity of Ti colloid attached to the surface of the steel sheet at the time of surface conditioning treatment. Also in the present invention, it is perceived that the "electrochemically inhomogeneous field" is formed around the Mn—Si composite oxide, making it easier for the zinc phosphate crystal to adhere to the oxide at the time of chemical conversion treatment and thereby enabling the process to achieve favorable chemical conversion treatability.

From the viewpoint of coating film adhesion, it is regarded preferable that the zinc phosphate crystal after chemical conversion treatment is in the size of a few micro meters or less. Thus, it is also considered desirable that the electrochemically inhomogeneous field as abovementioned is composed in the order of a few micro meters or less. For this reason, 10 or more pieces/100 $\mu m^2$ of Mn—Si composite oxide having Mn/Si atom ratio of 0.5 or more and having a major axis of from 0.01 μm to 5 μm are made to exist (that is, one or more pieces per 10 $\mu m^2$ are made to exist on average) so that average distance between particles of the composite oxide may become a few micro meters, such state making it easy for the above electrochemically inhomogeneous field to be formed in the size specified.

The electrochemically inhomogeneous field cannot always be formed effectively with each and all of the existing Mn—Si composite oxide. Therefore, it will be better to make more than 50 pieces per 100 $\mu m^2$ of the above Mn—Si composite oxide stay on the site; more preferable will be more than 100 pieces per 100 $\mu m^2$; and still more preferable will be more than 150 piece on the same basis. As the Mn—Si composite oxide, one example is $Mn_2SiO_4$; in case Al content in the steel is high, the composite oxide may take the form of Mn—Si—Al composite oxide containing Al.

<Steel sheet surface coverage by oxide with Si as main component: 10% or less>

Even if proper quantity of Mn—Si composite oxide which is effective for producing zinc phosphate crystal is made to stay in the site, presence of any other substance that may disturb chemical conversion treatment would not permit good chemical conversion treatability to function entailing inferior coating film adhesion.

As mentioned above, if an oxide containing Si as the main component (an oxide which contains Si at an atom ratio of more than 67%) exists in the surface of the steel sheet, zinc phosphate crystal is not produced in the corresponding portion resulting in much degraded chemical conversion treatability. Therefore, the steel sheet surface coverage by an oxide with Si as the main component has been decided to be 10% or less.

Incidentally, the inventors of the present invention had proposed the technique for enhancing chemical conversion treatability by finely dispersing the oxide containing Si as the main component as mentioned above, and in the present invention which utilizes the above-mentioned function of the Mn—Si composite oxide, it has been found preferable that presence of any oxide containing Si as the main component should be avoided as much as possible. Therefore, the steel sheet surface coverage by an oxide containing Si as the main component should be withheld more preferably at 5% or less, or the most preferably at 0%.

<When SEM is used to observe a cross section in the proximity of the surface of the steel sheet at 2000× magnification, there should exist no crack which is 3 μm or less in width and 5 μm or more in depth in any ten fields of view.>

If there exist sharp cracks on the surface of the steel sheet, it is conceived that zinc phosphate crystal will not adhere to the corresponding portion at the time of chemical conversion treatment, as a result of which corrosion is apt to occur more easily in that portion entailing deterioration in coating film adhesion. In order to enhance coating film adhesion, it becomes important to suppress sharp cracks, which otherwise will disturb attachment of zinc phosphate crystal, as much as possible.

The inventors of the present invention had proposed the technique whereby the coating film adhesion can be enhanced by limiting the depth of presence of linear compound containing Si and oxygen (300 nm or less in width) to 10 μm or less. That technique premised that acid pickling would not be done after annealing. But, actually the steel sheets are more often than otherwise subject to acid pickling after continuous annealing, and in this case, linear oxide is removed giving rise to cracks.

The quantitative relation between the depth of cracks and the linear oxide is not certain, but it is assumed that cracks are caused because the linear oxide is dissolved in acid as mentioned above or because the linear oxide falls off mechanically. Since dissolution in acid, etc., of the cracked portion proceeds even after removal of the above linear oxide, the cracks formed after the removal of the oxide are perceived to be deeper in depth than the actual presence of the linear oxide.

Thus, in the present invention, it was assumed that the coating film adhesion could be surely enhanced by controlling the cracks than defining the depth of the presence of the linear oxide in the way as the above-mentioned technique proposed previously. On such assumption, study was made of the shape of the cracks to have to be controlled (FIG. 1), to find out that the zinc phosphate crystal is hard to adhere to the cracks if the width of the cracks is equal to or less than the particle size of the zinc phosphate crystal and that the zinc phosphate crystal is hard to adhere to the cracks if the depth of the cracks is 5 μm or more. These observations have led us to determine that the cracks of 3 μm or less in width and 5 μm or more should be made the object for control.

Additionally it has been included in the requirement that when observation by SEM is made of a cross section in the proximity of the surface of the steel sheet at 2000× magnification, there should not exist any crack of the abovementioned size in any 10 fields of view.

In the present invention, the chemical composition has been defined as follows in order to ensure effective precipitation of the above Mn—Si composite oxide, suppress the specified cracks, and provide necessary properties as high-strength steel sheets.

<Si (% by mass)/Mn (% by mass)≤0.40>

As aforesaid, the oxide containing Si as the main component has a harmful influence on chemical conversion treatability, and therefore, it is preferable that the formation of oxide should be suppressed as much as possible rather than dispersed finely. Thus, the inventors of the present invention has decided that the ratio of the Si content in the steel (% by mass) against the Mn content in the steel (Si/Mn) should be suppressed at 0.40 or below, thereby enhancing chemical conversion treatability. More preferably, the Si/Mn ratio should be kept at 0.3 or below.

<C: 0.06-0.6%>

C is an element necessary for securing strength, and it should be contained at 0.06% or over (more preferably 0.09% or over). However, since excessive presence will impair weldability, the C content should be suppressed at 0.6% or less. Preferably, it is to be at 0.30% or less, or more preferably, at 0.20% or less.

<Si: 0.1-2%>

Si is an element effective to accelerate C concentration toward austenite, retain austenite at room temperature, and keep an excellent strength-ductility balance. To enable such effect to be fully exhibited, it is necessary to have Si contained at 0.1% or over, and preferably at 0.5% or over. On the other hand, excessive Si content is apt to produce Si oxide in the grain boundary and cause cracks after acid pickling. It also tends to intensify solid-solution strengthening too much causing increased rolling force. Therefore, the Si content should be suppressed at 2% or less, or preferably at 1.5% or less.

<Al ranging from 0.01-3%>

Al is an element having deoxidizing function. If Al content is lower than 0.01% for Al deoxidization, it may occur that deoxidization does not sufficiently proceed in the molten steel stage, permitting a large amount of surplus oxygen to remain in the steel in the form of oxide inclusion such as MnO and $SiO_2$, which state may lead to localized deterioration in workability. Like Si, Al is also an element effective to accelerate C concentration toward austenite, retain austenite at room temperature, and keep an excellent strength-ductility balance. From the viewpoint of enabling such effect to be fully exhibited, it is necessary to have Al contained at 0.01% or over, and preferably at 0.2% or over. On the other hand, excessive Al content is apt not only to saturate the effect of having secured retained austenite but also bring on embrittlement of the steel and higher cost. For these reasons, the Al content should be suppressed at 3% or less (preferably at 2% or less).

<Si+Al: 1-4%>

In order to secure sufficient amount of retained austenite to let the steel sheet exert good workability (ductility) stably, it is desirable that the steel sheet should contain 1% or more of Si and Al combined (preferably 1.2% or more of Si and Al combined. But, since excessive presence of Si and Al would cause the steel itself to become embrittled, the combined amount of Si and Al needs to be suppressed at 4% or below (preferably 3% or below).

<Mn ranging from 1-6%>

Mn is an element necessary for securing strength, and it is also an element effective for securing retained austenite to enhance workability (ductility). To have these effects exerted, Mn content should be arranged to be 1% or over, or more preferably 1.3% or over. But, as excessive Mn presence causes degradation in ductility and weldability, Mn content should be suppressed at 6% or less, or more preferably 3% or less.

The component elements defined in the present invention are as mentioned above, and the remaining component is Fe substantively. But, some other elements such as S (sulfur) of 0.02% or less, N (nitrogen) of 0.01% or less, O (oxygen) of 0.01% or less, and other unavoidable impurities which may slip in depending on raw materials, other materials, and production facilities are of course allowable. Furthermore, it is also possible to positively take in still other elements such as Cr, Mo, Ti, Nb, V, P, and B insofar as these elements have no adverse effect on the above-mentioned performance of the present invention.

In short, from the viewpoint of increasing strength of the steel sheet, Cr, Mo, Ti, Nb, V, P, and B may be added with containable limits being set as 0.01% or more for Cr, 0.01% or more for Mo, 0.005% or more for Ti, 0.005% or more for Nb, 0.005% or more for V, 0.0005% or more for P, 0.0003% or more for B, but to avoid decrease in ductility due to excessive addition, it is preferable to suppress the upper limits as 1% or less for Cr and Mo, 0.1% or less for Ti, Nb, and P, 0.3% or less for V, and 0.01% or less for B.

EMBODIMENT 1

The present invention is intended for the so-called TRIP steel sheet having a parent phase structure composed of bainitic ferrite and polygonal ferrite, with retained austenite being present in the structure, wherein, in the course of work deformation, the retained austenite carries out induced transformation (strain induced transformation or TRIP transformation induced plasticity) and thereby obtains excellent ductility.

The combined amount of bainitic ferrite and polygonal ferrite is 75% or more, or preferably 80% or more; the upper limit which is controlled according to the balance with the amount of the retained austenite described afterward is recommended to be adjusted appropriately so as to be able to obtain a desired high-level workability. Incidentally, the bainitic ferrite in the present invention is different from the bainite structure in that the bainitic ferrite does not have carbide in the structure. The bainitic ferrite is also different from the polygonal ferrite which has a very small dislocation density and from the structure of the quasi-polygonal ferrite which has a lower structure of fine subgrain, etc. (Reference is made to "Photo Collection of Bainite of Steel—1," Basics Study Group, Iron and Steel Institute of Japan.) Out of the above parent phase structures, the bainitic ferrite is a structure to contribute to securement of strength and enhancement of hydrogen embrittlement resistive properties; and the polygonal ferrite is a structure to contribute to securement of ductility; both of the structures need to be controlled to a most proper balance.

Thus, the bainitic ferrite should be maintained at 40% or over, and the polygonal ferrite at 1-50%. It is more preferable if the bainitic ferrite is kept at 50% or over, and the polygonal ferrite at 30% or below.

As mentioned above, the steel sheet in the present invention is to contain the retained austenite at 3% or over, or more preferably at 5% or over, so as to be able to exert an excellent ductility. On the other hand, as an excessive amount of retained austenite causes degradation in stretch flangeability, it is preferable to set the upper limit at 25%. With a view to improving the properties in hydrogen embrittlement resistivity, it is preferable that the retained austenite is present in the bainitic ferrite in a lath shape. What is described here as being "in a lath shape," means that the average ratio of axes (long axis/short axis) is 2 or over (preferably 4 or over, and with the preferred upper limit of 30).

Incidentally, as shown in the embodiment described later, the space factor of the bainitic ferrite in the present invention is obtained by subtracting a combined space factor of the polygonal ferrite and the retained austenite from the total structure (100%), and the space factor of the bainitic ferrite obtained in the above way may include, within the extent not adversely affecting the performance of the present invention, the bainite and martensite that may be unavoidably formed in the production process of the present invention.

The manufacturing method for obtainment of the steel sheet in the present invention is not particularly limited, but for the purpose of controlling the shape of the oxide precipitated on the surface of the steel sheet according to the requirement (I) set forth above to enhance chemical conversion treatability, it is essential to satisfy the chemical composition as specified. Besides, it is effective to immerse the steel sheet after hot rolling in hydrochloric acid of temperature 70-90° C. and of 5-16% by mass for 40 seconds or over (preferably 60 seconds or over) and also to suppress the dew point during continuous annealing at −40° C. or less (preferably −45° C. or less). Additionally, as to pickling time in hydrochloric acid, if a plurality of pickling baths are provided for intermittent immersions, it will be enough if an aggregate time of respective immersions is 40 seconds or over.

Also, in order to avoid formation of cracks as specified above as the requirement (II), it is essential to satisfy the chemical composition as specified. Besides, in the manufacturing process, the roll-up temperature in the hot rolling process is to be 500° C. or below (preferably 480° C. or below), and after the hot rolling process, the steel sheet is to be immersed in hydrochloric acid of 5-16% by mass maintained at a temperature of 70-90° C. for 40 seconds or over (preferably 60 seconds or over), while setting the dew point during the continuous annealing at −40° C. or less (preferably −45° C. or less). Further, as the cooling method in the continuous annealing process, the cooling by gas jet blowing without use of water (GJ) or the heat extraction by the water-cooled roll (RQ) may be adopted. As to mist cooling, it is effective to use the mist cooling from the state of the steel sheet being at a temperature of 550° C. or below (preferably 450° C. or below)

In addition, in order to enable the parent phase structure to secure the combined structure of the bainitic ferrite of 40% by mass or over and polygonal ferrite, it is recommendable to conduct heat treatment on the following conditions while controlling the dewpoint during the continuous annealing process to the abovementioned condition.

(A) Temperature of 850° C. or over be applied and maintained for 10-200 seconds;

(B) the steel sheet be cooled at an average cooling rate of 3° C./sec or over, thereby avoiding occurrence of pearlitic transformation, to the bainitic transformation temperature region (about 500-350° C.); and (C) staying in that temperature region be kept for 10 seconds or over.

Soaking at a temperature of 850° C. or over, as specified in (A) above, is effective for dissolving carbide completely and forming a retained austenite as desired. The above is also effective for obtaining a bainite having a high dislocation density in the cooling process after soaking. It will be good to set a holding time of 10-200 seconds for the above temperature. If the time is made shorter, it will be difficult to fully receive the above-mentioned effect from soaking, and if made longer on the other hand, the crystal grain will become coarse. Still more preferable is 20-150 seconds.

Then, according to (B) above, it will do to cool the steel sheet at an average cooling rate of 3° C./sec or over, preferably 5° C./sec or over, thereby avoiding occurrence of pearlitic transformation, until reaching the bainitic transformation temperature region (about 500-350° C.). By controlling the average cooling rate, it becomes possible to introduce a large amount of dislocations into the bainitic ferrite and secure a desired strength. With a view to enhancing strength, the upper limit of the average cooling rate does not need to be particularly specified; the higher the rate is, the better it will be, but an appropriate control of the cooling rate is recommended for the sake of actual operation.

The above control of the cooling rate is done well up to the bainitic transformation temperature region. Otherwise, that is, if the control is ended early in a region of a temperature higher than specified and, after that, cooling is continued at a lower rate, for example, it will not be possible to introduce dislocations sufficiently, produce retained austenite, and secure good workability. On the other hand, cooling continued at the above specified rate up to a region of a temperature lower than specified is undesirable, as it will neither be able to achieve producing retained austenite and securing good workability.

After cooling, staying in the above temperature region as specified in the above (C) should be maintained for 10 seconds or over. In this way, carbon condensing toward retained austenite can be performed efficiently within a short time, providing a large amount of stable retained austenite, as a result of which the TRIP effect by the retained austenite can be exerted fully. On the other hand, it is not desirable if the temperature after cooling is kept for too long a time, because recovery of dislocation is to occur, causing decrease of dislocations formed through the abovementioned cooling process and making it difficult to secure strength.

Other manufacturing conditions are not particularly limited. It will do if slabs are produced by continuous casting or mold casting after smelting according as commonly practiced and then brought to the processes of hot rolling and subsequent cold rolling. In the above hot rolling process, commonly practiced conditions may be adopted except for the wind up temperature. After completion of hot rolling at 850° C. or over, such conditions as to do cooling at an average cooling rate of about 30° C./sec and wind up at a temperature of about 400-500° C. may well be adopted. Also, in the cold rolling process, it is recommended to conduct cold rolling at a cold rolling reduction ratio of about 30-70%. Needless to say, the foregoing conditions are just illustrations to which the present invention is not limited in any way. The embodiment described afterward assumes acid pickling after continuous annealing, but it does not matter either whether such pickling is done or not. Further, if a flash plating with a small amount of Ni is applied to the steel after annealing or after annealing and pickling, it is valid and effective for making a chemical conversion film of a very fine grain.

EMBODIMENT 2

The present invention is intended for the so-called TRIP steel sheet having a parent phase structure composed of tempered martensite and ferrite, with retained austenite (γR) being present in the structure, wherein, in the course of work deformation, the γR carries out induced transformation (strain induced transformation or TRIP=transformation induced plasticity) and thereby obtains excellent ductility.

The combined amount of tempered martensite and ferrite is 75% or more, or preferably 80% or more; the upper limit which is controlled according to the balance with the amount of the retained austenite described afterward is recommended to be adjusted appropriately so as to be able to obtain a desired high-level workability. Out of the above parent phase structures, the ferrite is a structure to contribute to securement of ductility; and the tempered martensite is a structure to contribute to securement of strength; both of the structures need to be controlled to a most proper balance.

Thus, the tempered martensite should be maintained at 50% or over, and the ferrite at 4-40%. It is more preferable if the tempered martensite is kept at 60% or over, and the ferrite at 30% or below.

As mentioned above, the steel sheet in the present invention is to contain the retained austenite at 3% or over, or more preferably at 5% or over, so as to be able to exert an excellent ductility. On the other hand, as an excessive amount of retained austenite causes degradation in stretch flangeability, it is preferable to set the upper limit at 25%. With a view to improving the ductility, it is preferable that the retained austenite is present in the tempered martensite in a lath shape. What is described here as being "in a lath shape," means that the average ratio of axes (long axis/short axis) is 2 or over (preferably 4 or over, and with the preferred upper limit is 30).

Besides the above-mentioned structures (that is, tempered martensite, ferrite, and retained austenite), the steel sheet in the present invention may include, within the extent not adversely affecting the performance of the present invention, the bainite and the bainitic ferrite that may be unavoidably formed in the production process of the present invention. However, the bainite and the bainitic ferrite etc. are recommended to be controlled at 10% or below, more preferably 5% or below on the basis of space factor.

The manufacturing method for obtainment of the steel sheet in the present invention is not particularly limited, but for the purpose of controlling the shape of the oxide precipitated on the surface of the steel sheet according to the requirement (I) set forth above to enhance chemical conversion treatability, it is essential to satisfy the chemical composition as specified. Besides, it is effective to immerse the steel sheet after hot rolling in hydrochloric acid of temperature 70-90° C. and of 5-16% by mass for 40 seconds or over (preferably 60 seconds or over) and also to suppress the dew point during continuous annealing at −40° C. or less (preferably −45° C. or less). Additionally, as to pickling time in hydrochloric acid, if a plurality of pickling baths are provided for intermittent immersions, it will be enough if an aggregate time of respective immersions is 40 seconds or over.

Also, in order to avoid formation of cracks as specified above as the requirement (II), it is essential to satisfy the chemical composition as specified. Besides, in the manufacturing process, the roll-up temperature in the hot rolling process is to be 500° C. or below (preferably 480° C. or below), and after the hot rolling process, the steel sheet is to be immersed in hydrochloric acid of 5-16% by mass maintained at a temperature of 70-90° C. for 40 seconds or over (preferably 60 seconds or over), while setting the dew point during the continuous annealing at −40° C. or less (preferably −45° C. or less). Further, as the cooling method in the continuous annealing process, the cooling by gas jet blow without use of water (GJ) or the heat extraction by the water-cooled roll (RQ) may be adopted. As to mist cooling, it is effective to use the mist cooling from the state of the steel sheet being at a temperature of 550° C. or below (preferably 450° C. or below)

In addition, shown below are the two typical patterns of manufacturing processes in order to secure, on the basis of space factor, the combined structure of the tempered martensite of 50% by mass or over and the ferrite, as the parent phase structure.

(1) hot rolling-acid pickling-(cold rolling)-continuous annealing

In the above hot rolling process, it is recommendable to finalize the finish rolling at a temperature of 850° C. or over and also to cool down at an average cooling rate of 10° C./sec or over below Ms point for wind-up. As above-mentioned, cooling after finish rolling at an average cooling rate of 10° C./sec or over (preferably 20° C./sec or over) is made down to a temperature below Ms point, thereby avoiding pearlitic transformation, so that the desired combined structure (martensite+ferrite) can be obtained.

The wind-up temperature is required to be kept below Ms point, because the desired martensite cannot be obtained, while bainite, etc., are to be formed, if the wind-up temperature goes up above Ms point. By the way, the Ms point can be calculated by the following formula (2).

$$Ms=561-474\times[C]-33\times[Mn]-17\times[Ni]-17\times[Cr]-21\times[Mo] \quad (2)$$

(In the formula, [ ] means % by mass of each element indicated.)

The continuous annealing may be made subsequent to the above hot rolling, or the hot rolling is immediately followed by the cold rolling, after which the continuous annealing may be made. The cold rolling, if it is to be done, is recommended to be made at a cold rolling rate of 1-30%, because cold rolling made at over 30% causes anisotropy in the structure of the tempered martensite after annealing resulting in deteriorated ductility.

It is recommendable that the above-mentioned continuous annealing should include the following processes.

(A) A process in which temperature is kept at 700-900° C. for 10-600 seconds.

(B) A process in which cooling is made at an average cooling rate of 3° C./sec or over down to a temperature of 300° C. or over and 480° C. or below (C) A process in which the temperature range as indicated in the above item (B) is kept for 10 seconds or more.

By passing through the above processes, the parent phase structure formed in the above hot rolling process is tempered to obtain the desired mixed structure (a mixed structure of tempered martensite and ferrite) and also obtain retained austenite.

Firstly, by (A) soaking at 700-900° C. for 10-600 seconds, the desired mixed structure and the austenite are formed (annealing in two-phase region). If the temperature exceeds the upper limit, all turns out to be austenite within a short time, and if the temperature underruns the lower limit, it becomes difficult to obtain retained austenite. Further, it is recommendable to hold the heating time for 10 seconds or over to obtain the desired parent structure and retained austenite, preferably 20 seconds or over, or more preferably 30 seconds or more. If it exceeds 600 seconds, it becomes difficult to maintain the lath-shaped structure that characterizes the tempered martensite, leading to deterioration in mechanical properties. Preferably, heating time should be set at 500 seconds or less, or more preferably, at 400 seconds or less.

Secondly, (B) while the average cooling rate (CR) should be controlled at 3° C./sec or over (preferably, 5° C./sec or over), the temperature should be cooled down to 300° C. or over (preferably 350° C. or over) or to 480° C. or below (preferably 450° C. or below), while avoiding pearlitic transformation, and (C) furthermore, the temperature should be maintained in the above range for seconds or over (preferably 20 seconds or over) (austempering treatment). In this manner, it is possible to condense a large amount of carbon in the retained austenite within an extremely short time.

If the average cooling rate underruns the above range, the desired structure cannot be obtained, and formation of pearlite, etc., is likely. The upper limit of the average cooling rate does not need to be particularly specified; the higher the rate is, the better it will be, but an appropriate control of the cooling rate is recommended for the sake of actual operation.

Cooling and austempering treatment are processed as above-mentioned. In particular, the temperature for austempering is important in order to obtain the desired structure and make the present invention exhibit its function. When controlled within the above temperature range, the steel sheet acquires a large amount of stable retained austenite and exerts TRIP effect thereby. When the above holding temperature is below 300° C., the martensite will come to be present in an excessive amount, and on the other hand, when the temperature moves up beyond 480° C., the bainite phase will increase, an undesirable state as deterioration is occurring in ductility.

The upper limit for the above temperature holding time is not particularly limited. Considering the time required for the austenite to be transformed into the bainite, it is desirable to control the holding time at 3000 seconds or below, or preferably, 2000 seconds or below.

(2) Hot rolling-acid pickling-cold rolling-first continuous annealing-second continuous annealing The hot rolling process and the cold rolling process are firstly put into operation. These processes have nothing to be particularly limited except for the point of improvement in coating film adhesion described earlier and can be executed by choosing and adopting appropriate conditions out of those commonly practiced. The method in the present invention is characterized in that it does not intend to secure a desired structure in these hot rolling and cold rolling processes but that it does achieve the desired structure by controlling the subsequent processes of the first continuous annealing and the second continuous annealing.

In concrete terms, the above hot rolling process may adopt such conditions that after finishing hot rolling at 850° C. or over, cooling is made at an average cooling rate of 30° C./sec, and then wind-up is made at a temperature of 400-500° C. In the cold rolling process, it is recommendable to carry out cold rolling at a cold rolling ratio of about 30-70%. Needless to say, the foregoing comments are just illustrations to which the present invention is not limited in any way.

Secondly, the first continuous annealing process (a backup continuous annealing process) is recommended to include:

a process to apply and hold heat at a temperature of 800° C. or over; and a process to perform cooling, at an average cooling rate of 10° C./sec or over, down to a temperature below Ms point.

By passing through these processes, it becomes possible to obtain the parent phase structure as desired.

After soaking at a temperature of 800° C. or over, cooling with the average cooling rate (CR) controlled at 10° C./sec or over (preferably 20° C./sec or over) is made down to a temperature below Ms point, thereby avoiding occurrence of pearlitic transformation, so as to obtain the desired mixed structure (tempered martensite+ferrite). Additionally, after the first continuous annealing in the present invention, ferrite is recommended to be controlled at less than 30%. In that case, it is preferable to control the average cooling rate at 30° C./sec or over.

Also, the above average cooling rate affects not only the formation of ferrite but also the shape of retained austenite. If the average cooling rate is fast (preferably 30° C./sec or over, and more preferably 50° C./sec or over), it will be effective in forming the retained austenite in a lath shape. Incidentally, the upper limit of the average cooling rate is not particularly limited. The larger the rate is, the better the result will be, but an appropriate control of the cooling rate is recommended for the sake of actual operation.

The second continuous annealing process is recommended to include:

a process to apply and hold heat at a temperature of 700-900° C. for 10 to 600 seconds;

a process to perform cooling, at an average cooling rate of 3° C./sec or over, down to a temperature of 300-480° C.; and a process to hold temperature in that region for more than 10 seconds.

The above processes are the same as the continuous annealing process according to the method (1) described earlier, and by passing through the above processes, the parent phase structure formed in the first continuous annealing process is tempered and can be turned into a desired structure (tempered martensite and ferrite) while the retained austenite is also obtainable at the same time.

As to other manufacturing conditions, it will do if slabs are produced by continuous casting or mold casting after smelting according as commonly practiced. The embodiment described afterward assumes acid pickling after continuous annealing, but it does not matter either whether such pickling is done or not. Further, if a flash plating with a small amount of Ni is applied to the steel after annealing or after annealing and pickling, it is valid and effective for making a chemical conversion film of a very fine grain.

The steel sheet according to the present invention is excellent not only in coating film adhesion as mentioned above but also in the balance among strength, elongation, and stretch flangeability. Therefore, you can work this steel sheet into steel components successfully. The steel components thus obtained are provided with excellent properties in strength as well as in coating film adhesion. Such steel components, for example, includes structural parts for automobiles and industrial machinery; more concretely speaking, the center pillar reinforcement, which is a steel part of automobile or a body structural part, may be pointed out as a typical example.

The present invention is to be explained in more detail hereinafter by citing embodiments. It is noted that the present invention inherently is not limited to these embodiments described below and that the embodiments described herein can be implemented with addition of appropriate modifications within the extent conformable to the content and the spirit of the descriptions hereinabove and hereinbelow, all such modifications being regarded to be within the technical scope of the present invention.

The examples 1 and 2 relate to the above embodiments 1, and the examples 3 and 4 relate to the above embodiment 2.

EXAMPLE 1

The slabs obtainable from smelting and casting of the steel material of the chemical composition shown in Table 1 were made to undergo hot rolling and then acid pickling. The manufacturing conditions are shown in Table 2. Acid pickling was made in hydrochloric acid solution of temperature at 70-90° C. and concentration at 10-16% by mass. Then, cold rolling was made to yield 1.6 mm thick steel sheet. Cooling after soaking in the continuous annealing could well be performed by one of mist cooling, GJ, or RQ, or by a combination among the three. After the cooling, the conditions (temperature and time) in Table 2 were maintained. In case of mist cooling, after a holding time, the steel sheet was immersed in hydrochloric acid solution of temperature at 50° C. and concentration at 5% by mass for 5 seconds (acid pickling). The dew point was the same as the atmospheric dew point of the continuous annealing furnace excepting the mist cooling section.

Check was made of the steel sheet thus obtained as to the metallographic structure in the following manner. That is, the steel sheet was subjected to the Lepera corrosion method and the structure was identified by observation under SEM and an optical microscope (1000× magnification). Then, the area ratio of polygonal ferrite was calculated. The area ratio of retained austenite was obtained by XRD (X-ray diffractometer). The area ratio of bainitic ferrite was obtained by subtracting the combined area ratio of polygonal ferrite and retained austenite from the total structure (100%), and therefore, it was inclusive of inevitably formed martensite and other structures.

Also, by using the steel sheet obtained, evaluation was made of the mechanical properties and the coating film adhesion properties. As to the mechanical properties, JIS No. 5 test specimens were taken for measurement of tensile strength (TS), total elongation (El), and yielding point (YP) The steel sheet is evaluated as having a "good workability," when the tensile strength (TS) is 780 MPa or over and the product of tensile strength and elongation (TS×El) is 19000 or over (17000 or over in case strength is 1180 MPa or over; and 15000 or over in case strength is 1370 MPa or over).

The hydrogen embrittlement resistivity was evaluated by making 15×65 mm test specimens; applying stress of 780 MPa to the specimens by four-point bending; immersing the specimens in the solution (0.5 mol sulfuric acid+0.01 mol KSCN [=potassium thiocyanate]); in the solution, applying a weaker potential than natural potential, namely −80 mV, to the specimens potentiostatically; and measuring the time until occurrence of crack (life duration to crack initiation) under such conditions. In the present example, the steel sheet that showed a life duration to crack initiation of more than 1000 seconds was evaluated as having a "good hydrogen embrittleness resistivity."

As to the coating film adhesion, check was made of chemical conversion treatability and existence of crack(s). The chemical conversion treatability was first checked in respect to the state of oxide on the surface of the steel sheet in the following manner. Then, the steel sheet was made to undergo chemical conversion treatment on the following conditions and observed by SEM (1000×) on the surface after the chemical conversion to examine adhering conditions of zinc phosphate crystal in 10 fields of view. The steel sheet is evaluated as "○" when zinc phosphate crystal is evenly attached in all 10 fields of view, and as "x" when there is any one field in which zinc phosphate crystal is not attached. The evaluation result is shown in Table 3.

Chemical conversion liquid: V (Nihon Parkerrizing Co., Ltd.)

Chemical conversion process: Degreasing→Water washing→Surface conditioning→Chemical conversion To examine the number of Mn—Si oxide, the replica film abstracted from the surface of the steel sheet was prepared and observed under TEM of 15000× magnification (H-800 manufactured by Hitachi, Ltd.) to take count of average number (per 100 $\mu m^2$) in any 20 fields of view.

The steel sheet surface covering ratio of the oxide composed mainly of Si was obtained by observing the sample processed by the abstracted replica method by TEM and by the image analysis method. The abstracted replica method was implemented by the following procedures (a) thru (d).

(a) Evaporated carbon is deposited on the surface of the steel sheet.
(b) On the flat surface of the sample, grid lines are cut in 2-3 mm squares.
(c) Carbon pieces are made to float up by corrosive effect of 10% acetylacetone and 90% methanol etching solution.
(d) The carbon pieces are preserved in alcohol for observation.

The sample treated as above was processed on TEM to take pictures (13 cm×11 cm) of 10 fields of view at 15000× magnification in order to measure the area of the oxide containing Si mainly (the oxide here means one in which Si occupies more than an atom ratio of 67% of the elements composing the oxide excepting oxygen) and work out the covering ratio of the oxide containing Si mainly.

Also, the existence of crack(s) was checked by SEM (S-4500 manufactured by Hitachi, Ltd.) at 2000× magnification by observing any 10 fields of view (one field of view: 13 cm×cm) in the proximity of the surface of a cross section of the steel sheet. The result is shown in Table 3.

TABLE 1

| | Component Composition (Mass %) * | | | | | | | | | | | | | | | |
|---|---|---|---|---|---|---|---|---|---|---|---|---|---|---|---|---|
| Steel Type No. | C | Si | Mn | P | S | Al | Cr | Mo | Ti | Nb | V | B | N | O | Si/Mn | Si + Al |
| 1 | 0.17 | 0.68 | 2.30 | 0.013 | 0.004 | 1.17 | — | — | — | — | — | — | 0.0028 | 0.0022 | 0.296 | 1.85 |
| 2 | 0.13 | 0.98 | 2.55 | 0.004 | 0.001 | 1.48 | — | — | — | — | — | — | 0.0021 | 0.0018 | 0.384 | 2.46 |
| 3 | 0.09 | 0.90 | 2.38 | 0.003 | 0.004 | 1.25 | — | — | — | — | — | — | 0.0035 | 0.0022 | 0.378 | 2.15 |
| 4 | 0.17 | 0.49 | 1.51 | 0.012 | 0.004 | 0.82 | — | — | — | — | — | — | 0.0015 | 0.0015 | 0.325 | 1.31 |
| 5 | 0.22 | 1.03 | 2.74 | 0.012 | 0.003 | 0.08 | — | — | — | — | — | — | 0.0021 | 0.0014 | 0.376 | 1.11 |
| 6 | 0.16 | 0.78 | 2.10 | 0.009 | 0.007 | 1.55 | — | — | — | — | — | — | 0.0029 | 0.0024 | 0.371 | 2.33 |
| 7 | 0.29 | 0.63 | 1.85 | 0.012 | 0.007 | 0.94 | — | — | — | — | — | — | 0.0012 | 0.0012 | 0.341 | 1.57 |
| 8 | 0.12 | 0.64 | 2.08 | 0.005 | 0.004 | 1.09 | 0.29 | — | — | — | — | — | 0.0016 | 0.0013 | 0.308 | 1.73 |
| 9 | 0.20 | 0.53 | 1.83 | 0.012 | 0.008 | 1.12 | — | 0.19 | — | — | — | — | 0.0024 | 0.0017 | 0.290 | 1.65 |
| 10 | 0.19 | 0.70 | 2.58 | 0.009 | 0.006 | 1.73 | — | — | 0.017 | — | — | — | 0.0028 | 0.0016 | 0.271 | 2.43 |
| 11 | 0.15 | 0.93 | 2.40 | 0.013 | 0.005 | 1.38 | — | — | — | 0.026 | — | — | 0.0037 | 0.0010 | 0.388 | 2.31 |
| 12 | 0.17 | 0.67 | 2.01 | 0.007 | 0.007 | 1.15 | — | — | — | — | 0.042 | — | 0.0022 | 0.0017 | 0.333 | 1.82 |
| 13 | 0.13 | 0.37 | 1.77 | 0.005 | 0.005 | 1.32 | — | — | — | — | — | 0.0012 | 0.0023 | 0.0015 | 0.209 | 1.69 |
| 14 | 0.15 | 0.59 | 2.69 | 0.012 | 0.004 | 0.51 | 0.09 | — | 0.021 | — | — | — | 0.0009 | 0.0023 | 0.219 | 1.10 |
| 15 | 0.19 | 1.07 | 2.93 | 0.006 | 0.002 | 0.12 | — | 0.06 | — | — | 0.058 | 0.0014 | 0.0033 | 0.0021 | 0.365 | 1.19 |
| 16 | 0.18 | 1.23 | 3.17 | 0.012 | 0.011 | 0.07 | 0.16 | — | — | 0.008 | — | — | 0.0032 | 0.0014 | 0.388 | 1.30 |
| 17 | 0.20 | 0.04 | 1.81 | 0.014 | 0.002 | 1.21 | — | — | 0.016 | — | — | 0.0009 | 0.0014 | 0.0013 | 0.022 | 1.25 |

TABLE 1-continued

| Steel Type No. | Component Composition (Mass %) * | | | | | | | | | | | | | | | |
|---|---|---|---|---|---|---|---|---|---|---|---|---|---|---|---|---|
| | C | Si | Mn | P | S | Al | Cr | Mo | Ti | Nb | V | B | N | O | Si/Mn | Si + Al |
| 18 | 0.22 | 2.27 | 2.33 | 0.003 | 0.003 | 0.12 | — | — | — | — | — | — | 0.0022 | 0.0023 | 0.974 | 2.39 |
| 19 | 0.22 | 1.09 | 0.79 | 0.009 | 0.012 | 1.57 | 0.18 | 0.09 | — | — | 0.035 | — | 0.0008 | 0.0012 | 1.380 | 2.66 |
| 20 | 0.14 | 0.40 | 2.34 | 0.009 | 0.007 | 0.07 | — | 0.04 | — | 0.011 | — | — | 0.0036 | 0.0023 | 0.171 | 0.47 |
| 21 | 0.17 | 1.27 | 1.90 | 0.006 | 0.005 | 1.39 | — | — | 0.011 | — | — | — | 0.0020 | 0.0014 | 0.668 | 2.66 |
| 22 | 0.12 | 0.93 | 2.07 | 0.004 | 0.007 | 0.63 | — | — | 0.009 | — | — | — | 0.0027 | 0.0011 | 0.449 | 1.56 |

* Rest includes iron and inevitable impurities.

TABLE 2

| Experiment No. | Steel Type No. | Hot Rolling and Pickling | | Continuous Annealing | | | | | | |
|---|---|---|---|---|---|---|---|---|---|---|
| | | Wind-up Temperature ° C. | Pickling Time sec | Soaking Temperature ° C. | Soaking Time sec | Average Cooling Rate ° C./sec | Cooling Method | Holding Temperature ° C. | Holding Time sec | Dew Point ° C. |
| 1 | 1 | 480 | 50 | 15 | 40 | 25 | GJ | 430 | 100 | −50 |
| 2 | 2 | 440 | 50 | 880 | 80 | | GJ | 430 | 110 | −40 |
| 3 | 3 | 480 | 40 | 890 | 80 | 15 | GJ | 400 | 140 | −50 |
| 4 | 4 | 490 | 60 | 890 | 50 | 20 | GJ | 400 | 260 | −50 |
| 5 | 5 | 460 | 50 | 890 | 70 | 15 | GJ | 420 | 240 | −50 |
| 6 | 6 | 490 | 60 | 860 | 80 | 10 | GJ | 420 | 170 | −60 |
| 7 | 7 | 480 | 50 | 860 | 30 | 20 | GJ | 430 | 140 | −50 |
| 8 | 8 | 440 | 50 | 880 | 60 | 35 | GJ + RQ | 420 | 180 | −40 |
| 9 | 9 | 430 | 50 | 860 | 70 | 35 | GJ + RQ | 410 | 200 | −50 |
| 10 | 10 | 460 | 60 | 900 | 50 | 25 | GJ + RQ | 430 | 160 | −40 |
| 11 | 11 | 460 | 50 | 880 | 40 | 30 | GJ + RQ | 420 | 110 | −40 |
| 12 | 12 | 490 | 60 | 870 | 50 | 20 | GJ + RQ | 410 | 260 | −50 |
| 13 | 13 | 490 | 60 | 890 | 50 | 25 | GJ + RQ | 420 | 120 | −40 |
| 14 | 14 | 490 | 60 | 870 | 50 | 25 | GJ + RQ | 430 | 250 | −40 |
| 15 | 15 | 450 | 50 | 870 | 90 | 30 | GJ + RQ | 400 | 220 | −50 |
| 16 | 16 | 480 | 50 | 880 | 40 | 20 | GJ + RQ | 420 | 120 | −60 |
| 17 | 17 | 470 | 50 | 890 | 40 | 10 | GJ | 390 | 180 | −50 |
| 18 | 18 | 450 | 60 | 900 | 50 | 10 | GJ | 400 | 90 | −50 |
| 19 | 19 | 450 | 40 | 870 | 80 | 3 | GJ | 420 | 110 | −40 |
| 20 | 20 | 460 | 50 | 870 | 70 | 15 | GJ | 410 | 120 | −50 |
| 21 | 21 | 470 | 40 | 900 | 30 | 20 | GJ | 400 | 160 | −40 |
| 22 | 22 | 450 | 50 | 870 | 70 | 15 | GJ | 410 | 220 | −40 |
| 23 | 2 | 460 | 50 | 890 | 50 | 35 | GJ + RQ | 410 | 160 | −50 |
| 24 | 2 | 470 | 50 | 880 | 80 | 70 | GJ + Mist | 420 | 230 | −50 |
| 25 | 2 | 470 | 50 | 860 | 60 | 10 | GJ | 420 | 170 | −50 |
| 26 | 1 | 440 | 60 | 900 | 40 | 25 | GJ + RQ | 400 | 100 | −40 |
| 27 | 1 | 620 | 50 | 880 | 50 | 30 | GJ + RQ | 430 | 270 | −40 |
| 28 | 1 | 490 | 5 | 860 | 50 | 25 | GJ + RQ | 400 | 250 | −50 |
| 29 | 1 | 490 | 50 | 870 | 40 | 20 | GJ + RQ | 400 | 130 | −20 |

TABLE 3

| Experiment No. | Metal Structure | | | Mechanical Properties | | | | Hydrogen Embrittlement Resistivity | Superficial Oxide | | Coating Film Adhesion | |
|---|---|---|---|---|---|---|---|---|---|---|---|---|
| | Bainitic Ferrite Area % | Polygonal ferrite Area % | Retained Austenite Area % | YP MPa | TS MPa | EI % | TS × EL MPa · % | | Si—Mn Oxide *1 (No. of pcs) | Si(main) Oxide *2 % | Chemical Conversion Treatability | Crack(s) |
| 1 | 81 | 6 | 13 | 709 | 1201 | 14.5 | 17371 | not found | 15 | 0 | ○ | Nil |
| 2 | 83 | 7 | 10 | 825 | 1231 | 14.5 | 17820 | not found | 13 | 4 | ○ | Nil |
| 3 | 77 | 16 | 7 | 674 | 1037 | 19.7 | 20430 | not found | 33 | 4 | ○ | Nil |
| 4 | 82 | 6 | 12 | 532 | 934 | 23.0 | 21469 | not found | 38 | 0 | ○ | Nil |
| 5 | 75 | 16 | 9 | 769 | 1303 | 12.6 | 16361 | not found | 31 | 4 | ○ | Nil |
| 6 | 68 | 25 | 7 | 524 | 919 | 24.6 | 22629 | not found | 31 | 5 | ○ | Nil |
| 7 | 74 | 19 | 7 | 618 | 1066 | 19.2 | 20456 | not found | 28 | 0 | ○ | Nil |
| 8 | 87 | 7 | 6 | 803 | 1164 | 15.8 | 18387 | not found | 27 | 0 | ○ | Nil |
| 9 | 92 | 2 | 6 | 803 | 1235 | 14.8 | 18283 | not found | 18 | 0 | ○ | Nil |
| 10 | 84 | 6 | 10 | 927 | 1343 | 12.6 | 16948 | not found | 24 | 3 | ○ | Nil |
| 11 | 88 | 7 | 5 | 777 | 1234 | 14.1 | 17350 | not found | 37 | 2 | ○ | Nil |
| 12 | 80 | 9 | 11 | 676 | 1073 | 18.4 | 19783 | not found | 23 | 4 | ○ | Nil |
| 13 | 86 | 3 | 11 | 700 | 1029 | 20.0 | 20596 | not found | 22 | 0 | ○ | Nil |
| 14 | 90 | 1 | 9 | 972 | 1429 | 11.2 | 16047 | not found | 12 | 4 | ○ | Nil |
| 15 | 85 | 3 | 12 | 940 | 1492 | 11.3 | 16861 | not found | 21 | 3 | ○ | Nil |

TABLE 3-continued

| | Metal Structure | | | | | | | | Superficial Oxide | | Coating Film Adhesion | |
|---|---|---|---|---|---|---|---|---|---|---|---|---|
| | Bainitic | Polygonal | Retained | Mechanical Properties | | | | Hydrogen | Si—Mn | Si(main) | Chemical | |
| Experiment No. | Ferrite Area % | ferrite Area % | Austenite Area % | YP MPa | TS MPa | EI % | TS × EL MPa · % | Embrittlement Resistivity | Oxide *1 (No. of pcs) | Oxide *2 % | Conversion Treatability | Crack(s) |
| 16 | 87 | 4 | 9 | 1043 | 1580 | 9.9 | 15675 | not found | 14 | 4 | ○ | Nil |
| 17 | 73 | 26 | 1 | 549 | 931 | 18.5 | 17186 | not found | 14 | 0 | ○ | Nil |
| 18 | 73 | 22 | 5 | 640 | 1033 | 20.4 | 21045 | not found | 6 | 55 | x | Existed |
| 19 | 35 | 64 | 1 | 507 | 845 | 21.1 | 17789 | found | 5 | 32 | x | Nil |
| 20 | 85 | 13 | 2 | 835 | 1193 | 13.8 | 16440 | not found | 18 | 0 | ○ | Nil |
| 21 | 67 | 20 | 13 | 529 | 854 | 29.1 | 24871 | not found | 4 | 46 | x | Nil |
| 22 | 77 | 11 | 12 | 544 | 989 | 22.0 | 21739 | not found | 6 | 58 | x | Nil |
| 23 | 83 | 6 | 11 | 717 | 1237 | 14.3 | 17705 | not found | 20 | 0 | ○ | Nil |
| 24 | 87 | 6 | 7 | 857 | 1261 | 14.1 | 17720 | not found | 24 | 3 | ○ | Existed |
| 25 | 77 | 17 | 6 | 795 | 1135 | 17.6 | 19935 | not found | 22 | 0 | ○ | Nil |
| 26 | 81 | 6 | 13 | 697 | 1201 | 15.3 | 18357 | not found | 32 | 0 | ○ | Nil |
| 27 | 92 | 4 | 4 | 844 | 1279 | 13.9 | 17729 | not found | 19 | 2 | ○ | Existed |
| 28 | 79 | 8 | 13 | 812 | 1177 | 17.0 | 19975 | not found | 5 | 23 | x | Existed |
| 29 | 84 | 12 | 4 | 722 | 1183 | 15.5 | 18304 | not found | 4 | 21 | x | Existed |

*1 Number per 100 $\mu m^2$ of Mn—Si composite oxide having atom ratio (Mn/Si) of 0.5 or over and major axis of 0.01-5 μm

*2 Steel sheet surface covering ratio of oxide containing Si as main component

From Tables 1-3, observations can be described as follows. (Nos. appearing below denote Experiment Nos.) Nos. 24 and 27 have satisfied the specific requirements as "the invention-related steel sheet 1" and have proven the excellent result in chemical conversion treatability and coating film adhesion. The related examples have shown it desirable that the manufacturing conditions in order to control the occurrence of cracks and secure excellent coating film adhesion, should give particular emphasis to wind-up temperature and cooling in the continuous annealing as preferred conditions No. 21 and 22 also have satisfied the specified requirements as "the invention-related steel sheet 2," having been successful in obtaining an excellent steel sheet without crack and with good coating film adhesion. In order to secure chemical conversion treatability and enhance coating film adhesion in the related examples, it will be preferred to control the component composition and make the shape of the oxide deposited on the surface of the steel sheet conform to the requirement.

Nos. 1-16, 23, 25, and 26 have satisfied the requirements as "the invention-related steel sheet 3" (that is, the requirements specified as "the invention-related steel sheet 1" and "the invention-related steel sheet 2" combined together), resulting that with the excellent chemical conversion treatability being secured and occurrence of cracks being controlled, the coating film adhesion is able to display excellent performance.

In contrast to the above, Nos. 17-20, 28, and 29 have not satisfied any of the requirements as "the invention-related steel sheets 1, 2 and 3," with a result that the steel sheet is neither excellent in coating film adhesion, nor in strength-ductility balance, and furthermore, none of the steel sheet displays good performance in high strength coupled with ductility.

Nos. 17-20 have not satisfied the component composition defined in the present invention, proving to be inferior either in mechanical properties or in coating film adhesion. That is, No. 17 was insufficient in the amount of Si, and so was No. 20 in the combined amount of Si and Al, both the cases resulting in inferior strength-ductility balance. Also, No. 18 has been found containing excessive amount of Si and exceeding the upper limit of Si/Mn ratio, both the cases entailing the steel sheet surface nonconforming to the requirements and the coating film adhesion being inferior.

No. 19 has been found containing too small an amount of Mn to secure retained austenite sufficiently, causing inferior strength-ductility balance. Further, the amount of bainitic ferrite is so short that the hydrogen embrittlement resistivity has become inferior, too.

Nos. 28 and 29 have not been manufactured according to the recommended conditions, nor in conformity with the shape of oxide specified in the present invention. For this reason, these steel sheets are inferior in the chemical conversion treatability and, due to cracks caused, in the coating film adhesion, too. As for No. 28, the acid pickling time is too short to remove the concentrated Si layer. As for No. 29, the high dew point enhances surface concentration of Si in the annealing process. Both the cases allow existence of a large amount of the oxide containing Si as the main component and also growth of Si oxide in the grain boundary. These have become the causes for the cracks occurring after acid pickling and for the inferior coating film adhesion.

Presented here for reference are the microgram of TEM observation showing the abstracted replica of the steel sheet obtained from the present embodiment and the photograph of SEM observation showing the surface of the steel sheet. FIG. 2 is a microgram of TEM observation of the surface of the steel sheet No. 18 as a comparative example. From this FIG. 2, it is clear that the surface layer region is covered with an oxide layer (the white-colored portion) containing Si as the main component.

FIG. 3 is a microgram of SEM observation of the surface of the steel sheet after chemical conversion treatment. It is obvious from this FIG. 3 that No. 18 has large clearances though zinc phosphate crystals are small.

In contrast to the above, FIG. 4 is a photograph of TEM observation of the surface of the steel sheet No. 7, an example of the present invention. In the surface layer region of the steel sheet, there is no such layer as is seen on the above No. 18 but there are particulate matters dispersed in a very fine state. In other words, it can be confirmed from FIG. 4 that in the surface layer region of the steel sheet No. 7, there is very little oxide containing Si as the main component which works to deteriorate the chemical conversion treatability, but there exists a considerable amount of Mn—Si composite oxide which is effective for enhancing the chemical conversion treatability.

FIG. 5 is a microgram of SEM observation of the surface of the same steel sheet as above after chemical conversion treatment. From this FIG. 5, it is well perceived that No. 7 has few clearances with small zinc phosphate crystals,

EXAMPLE 2

Press work was applied to the steel sheet No. 7 (1.6 mm thick) in the above Example 1 to form a test piece in a shape of a hat channel simulating the center pillar reinforcement, one of automobile body components. Also, a comparative test piece in the same shape was made of 1.8 mm thick material by JSC590Y of The Japan Iron and Steel Federation.

The test pieces were put to the three-point bending test in which the test pieces are held at both ends and given a load in the center by means of Amsler type testing machine, resulting that both the test pieces showed approximately equal load-displacement behavior. From this result, it can be perceived that using the steel sheet in the present invention for the manufacture of automobile body components will make thinner-walled structure possible and prove more effective in weight trimming of automobiles, than using the conventional steel sheet.

EXAMPLE 3

The slabs obtainable from smelting and casting of the steel material of the chemical composition shown in Table 1 (refer to Embodiment 1) were made to undergo hot rolling and then acid pickling. The manufacturing conditions are shown in Table 4. Acid pickling was made in hydrochloric acid solution of temperature at 70-90° C. and concentration at 10-16% by mass. Then, cold rolling was made to yield 1.6 mm thick steel sheet. Out of the steel sheet thus obtained, a portion was made to undergo the backup continuous annealing process (the first continuous annealing) and then the final continuous annealing process (the second continuous annealing). The remaining portion was made to undergo only one-round of continuous annealing (corresponding to the final continuous annealing process aforesaid). Cooling after soaking in the final continuous annealing could well be performed by one of mist cooling, GJ, or RQ, or by a combination among the three. After the cooling, the conditions (temperature and time) in Table 4 were maintained. In case of mist cooling, after a holding time, the steel sheet was immersed in hydrochloric acid solution of temperature at 50° C. and concentration at 5% by mass for 5 seconds (acid pickling). The dew point was the same as the atmospheric dew point of the continuous annealing furnace excepting the mist cooling section.

Check was made of the steel sheet thus obtained as to the metallographic structure in the following manner. That is, the steel sheet was subjected to the Lepera corrosion method and the structure was identified by observation under an optical microscope (1000× magnification). Then, the area ratio of ferrite was calculated by an optical microscope (1000× magnification). The area ratio of retained austenite was obtained by XRD (X-ray diffractometer). The area ratio of tempered martensite was obtained as the remaining portion (inclusive of bainite and other structures) after subtracting the combined area ratio of the above ferrite and retained austenite from the total structure (100%).

Also, by using the steel sheet obtained, evaluation was made of the mechanical properties and the coating film adhesion properties. As to the mechanical properties, JIS No. 5 test specimens were taken for measurement of tensile strength (TS), total elongation (El), and yielding point (YP). The steel sheet is evaluated as having a "good ductility," when the tensile strength (TS) is 780 MPa or over and the product of tensile strength and elongation (TS×El) is 19000 or over (18000 or over in case strength is 1180 MPa or over; and 17000 or over in case strength is 1370 MPa or over).

As to the coating film adhesion, check was made of chemical conversion treatability and existence of crack(s). The chemical conversion treatability was first checked in respect to the state of oxide on the surface of the steel sheet in the following manner. Then, the steel sheet was made to undergo chemical conversion treatment on the following conditions and observed by SEM (1000×) on the surface after the chemical conversion to examine adhering conditions of zinc phosphate crystals in 10 fields of view. The steel sheet is evaluated as "○" (or "OK") when zinc phosphate crystals are evenly attached in all 10 fields of view, and as "x" (or "No Good") when there exists any one field in which zinc phosphate crystal is not attached.

Chemical conversion liquid: Nihon Parkerizing Co., Ltd. Palbond L 3020

Chemical conversion process: Degreasing→water washing→surface conditioning→chemical conversion To examine the number of Mn—Si oxide, the replica film abstracted from the surface of the steel sheet was prepared and observed under TEM of 15000× magnification (H-800 manufactured by Hitachi, Ltd.) to take count of average number (per 100 $\mu m^2$) in any 20 fields of view.

The steel sheet surface covering ratio of the oxide containing Si as the main component was obtained by observing the sample processed by the abstracted replica method by TEM and by the image analysis method. The abstracted replica method was implemented by the following procedures (a) thru (d).

(a) Evaporated carbon is deposited on the surface of the steel sheet.

(b) On the flat surface of the sample, grid lines are cut in 2-3 mm squares.

(c) Carbon pieces are made to float up by corrosive effect of 10% acetylacetone and 90% methanol etching solution.

(d) The carbon pieces are preserved in alcohol for observation.

The sample treated as above was processed on TEM to take pictures (13 cm×11 cm) of 10 fields of view at 15000× magnification in order to measure the area of the oxide containing Si as the main component (the oxide here means one in which Si occupies more than an atom ratio of 67% of the elements composing the oxide excepting oxygen) and work out the covering ratio of the oxide containing Si as the main component.

Also, the existence or non-existence of crack(s) was checked by SEM (S-4500 manufactured by Hitachi, Ltd.) at 2000× magnification by observing any 10 fields of view (one field of view: 13 cm×11 cm) in the proximity of the surface of a cross section of the steel sheet. The result is shown in Table 5.

TABLE 4

| | | Hot Rolling and Pickling | | | | | Cold Rolling | Backup Continuous Annealing | | |
|---|---|---|---|---|---|---|---|---|---|---|
| Experiment No. | Steel Type No. | Finishing Temperature (° C.) | Cooling Rate (° C./sec) | Wind-up Temperature (° C.) | Pickling Time (sec) | Sheet Thickness (mm) | Cold Rolling Draft (%) | Sheet Thickness (mm) | Soaking Temperature (° C.) | Cooling Rate to Ms Point (° C./sec) |
| 101 | 1 | 890 | 60 | 50 | 50 | 2.0 | 20 | 1.6 | | |
| 102 | 2 | 910 | 55 | 70 | 50 | 2.0 | 20 | 1.6 | | |
| 103 | 3 | 870 | 50 | 50 | 40 | 2.0 | 20 | 1.6 | | |
| 104 | 4 | 880 | 60 | 90 | 60 | 2.0 | 20 | 1.6 | | |
| 105 | 5 | 890 | 30 | 480 | 50 | 3.2 | 50 | 1.6 | 850 | 50 |
| 106 | 6 | 900 | 35 | 480 | 60 | 3.2 | 50 | 1.6 | 880 | 45 |
| 107 | 7 | 890 | 30 | 480 | 50 | 3.2 | 50 | 1.6 | 870 | 45 |
| 108 | 8 | 900 | 50 | 100 | 50 | 1.8 | 11 | 1.6 | | |
| 109 | 9 | 860 | 50 | 50 | 50 | 1.8 | 11 | 1.6 | | |
| 110 | 10 | 890 | 30 | 90 | 60 | 1.8 | 11 | 1.6 | | |
| 111 | 11 | 890 | 50 | 70 | 50 | 1.8 | 11 | 1.6 | | |
| 112 | 12 | 880 | 40 | 450 | 60 | 3.2 | 50 | 1.6 | 840 | 55 |
| 113 | 13 | 860 | 50 | 450 | 60 | 3.2 | 50 | 1.6 | 850 | 35 |
| 114 | 14 | 890 | 35 | 450 | 60 | 3.2 | 50 | 1.6 | 880 | 35 |
| 115 | 15 | 880 | 45 | 450 | 50 | 3.2 | 50 | 1.6 | 870 | 45 |
| 116 | 16 | 900 | 50 | 450 | 50 | 3.2 | 50 | 1.6 | 880 | 30 |
| 117 | 17 | 890 | 45 | 40 | 50 | 2.0 | 20 | 1.6 | | |
| 118 | 18 | 900 | 50 | 70 | 60 | 2.0 | 20 | 1.6 | | |
| 119 | 19 | 890 | 35 | 50 | 40 | 2.0 | 20 | 1.6 | | |
| 120 | 20 | 890 | 30 | 430 | 50 | 3.2 | 50 | 1.6 | 880 | 20 |
| 121 | 21 | 900 | 45 | 430 | 40 | 3.2 | 50 | 1.6 | 870 | 30 |
| 122 | 22 | 880 | 40 | 430 | 50 | 3.2 | 50 | 1.6 | 890 | 25 |
| 123 | 2 | 880 | 40 | 90 | 50 | 2.0 | 20 | 1.6 | | |
| 124 | 2 | 870 | 60 | 60 | 50 | 2.0 | 20 | 1.6 | | |
| 125 | 2 | 880 | 30 | 100 | 50 | 2.0 | 20 | 1.6 | | |
| 126 | 1 | 890 | 55 | 450 | 60 | 3.2 | 50 | 1.6 | 840 | 40 |
| 127 | 1 | 890 | 35 | 630 | 50 | 3.2 | 50 | 1.6 | 840 | 20 |
| 128 | 1 | 880 | 55 | 450 | 5 | 3.2 | 50 | 1.6 | 850 | 35 |
| 129 | 1 | 900 | 40 | 450 | 50 | 3.2 | 50 | 1.6 | 860 | 30 |

| | | Continuous Annealing | | | | | | |
|---|---|---|---|---|---|---|---|---|
| Experiment No. | Steel Type No. | Soaking Temperature (° C.) | Soaking Time (sec) | Average Cooling Rate (° C./sec) | Cooling Method | Holding Temperature (° C.) | Holding Time (sec) | Dew Point (° C.) |
| 101 | 1 | 810 | 50 | 15 | GJ | 420 | 140 | −40 |
| 102 | 2 | 830 | 50 | 10 | GJ | 420 | 140 | −50 |
| 103 | 3 | 840 | 30 | 10 | GJ | 430 | 70 | −40 |
| 104 | 4 | 850 | 40 | 15 | GJ | 410 | 110 | −40 |
| 105 | 5 | 820 | 40 | 10 | GJ | 420 | 90 | −40 |
| 106 | 6 | 810 | 50 | 10 | GJ | 430 | 160 | −40 |
| 107 | 7 | 810 | 50 | 20 | GJ | 400 | 160 | −50 |
| 108 | 8 | 830 | 60 | 25 | GJ + RQ | 420 | 200 | −40 |
| 109 | 9 | 840 | 90 | 30 | GJ + RQ | 400 | 270 | −50 |
| 110 | 10 | 820 | 80 | 25 | GJ + RQ | 420 | 220 | −40 |
| 111 | 11 | 830 | 80 | 20 | GJ + RQ | 400 | 250 | −40 |
| 112 | 12 | 830 | 50 | 35 | GJ + RQ | 430 | 120 | −50 |
| 113 | 13 | 850 | 40 | 25 | GJ + RQ | 400 | 120 | −50 |
| 114 | 14 | 830 | 70 | 20 | GJ + RQ | 400 | 180 | −50 |
| 115 | 15 | 850 | 80 | 35 | GJ + RQ | 410 | 260 | −50 |
| 116 | 16 | 820 | 70 | 35 | GJ + RQ | 420 | 230 | −50 |
| 117 | 17 | 840 | 70 | 15 | GJ | 430 | 220 | −50 |
| 118 | 18 | 840 | 40 | 25 | GJ | 420 | 100 | −40 |
| 119 | 19 | 820 | 50 | 2 | GJ | 400 | 170 | −50 |
| 120 | 20 | 830 | 40 | 20 | GJ | 420 | 110 | −40 |
| 121 | 21 | 820 | 30 | 15 | GJ | 430 | 80 | −50 |
| 122 | 22 | 840 | 40 | 20 | GJ | 410 | 120 | −40 |
| 123 | 2 | 820 | 50 | 30 | GJ + RQ | 390 | 170 | −50 |
| 124 | 2 | 840 | 60 | 80 | GJ + MIST | 400 | 180 | −60 |
| 125 | 2 | 810 | 50 | 15 | GJ | 430 | 160 | −50 |
| 126 | 1 | 820 | 50 | 25 | GJ + RQ | 410 | 130 | −50 |
| 127 | 1 | 830 | 80 | 20 | GJ + RQ | 420 | 260 | −60 |
| 128 | 1 | 860 | 70 | 30 | GJ + RQ | 410 | 240 | −50 |
| 129 | 1 | 850 | 80 | 25 | GJ + RQ | 400 | 250 | −10 |

TABLE 5

| | Metal Structure | | | | | | | Superficial Oxide | | Coating Film Adhesion | |
|---|---|---|---|---|---|---|---|---|---|---|---|
| | Tempered | | Retained | Mechanical Properties | | | | Si—Mn | Si(main) | Chemical | |
| Experiment No. | Martensite (area %) | Ferrite (area %) | Austenite (area %) | YP (MPa) | TS (MPa) | EI (%) | ES × EI (MPa · %) | Oxide *1 (No. of pcs) | Oxide *2 (%) | Conversion Treatability | Crack(s) |
| 101 | 76 | 13 | 11 | 666 | 1129 | 17.6 | 19833 | 31 | 0 | ○ | Nil |
| 102 | 75 | 12 | 13 | 657 | 1153 | 17.4 | 20063 | 21 | 3 | ○ | Nil |
| 103 | 75 | 17 | 8 | 571 | 1019 | 19.7 | 20092 | 22 | 4 | ○ | Nil |
| 104 | 71 | 20 | 9 | 439 | 784 | 29.0 | 22704 | 27 | 0 | ○ | Nil |
| 105 | 65 | 24 | 11 | 717 | 1195 | 15.1 | 18069 | 33 | 5 | ○ | Nil |
| 106 | 81 | 10 | 9 | 500 | 1087 | 18.9 | 20591 | 14 | 4 | ○ | Nil |
| 107 | 72 | 21 | 7 | 490 | 1042 | 21.3 | 22201 | 24 | 0 | ○ | Nil |
| 108 | 77 | 9 | 14 | 524 | 1092 | 19.9 | 21704 | 38 | 0 | ○ | Nil |
| 109 | 73 | 20 | 7 | 456 | 1013 | 21.2 | 21495 | 31 | 0 | ○ | Nil |
| 110 | 74 | 15 | 11 | 639 | 1229 | 14.9 | 18260 | 28 | 2 | ○ | Nil |
| 111 | 77 | 14 | 9 | 676 | 1126 | 17.3 | 19455 | 14 | 4 | ○ | Nil |
| 112 | 76 | 12 | 12 | 505 | 1031 | 21.0 | 21605 | 18 | 3 | ○ | Nil |
| 113 | 66 | 25 | 9 | 396 | 797 | 29.9 | 23828 | 13 | 0 | ○ | Nil |
| 114 | 68 | 25 | 7 | 646 | 1153 | 16.5 | 19029 | 15 | 3 | ○ | Nil |
| 115 | 56 | 35 | 9 | 664 | 1126 | 17.6 | 19869 | 23 | 4 | ○ | Nil |
| 116 | 67 | 19 | 14 | 781 | 1372 | 12.5 | 17136 | 12 | 4 | ○ | Nil |
| 117 | 64 | 34 | 2 | 456 | 829 | 21.6 | 17918 | 37 | 0 | ○ | Nil |
| 118 | 74 | 16 | 10 | 634 | 1075 | 19.3 | 20695 | 6 | 68 | ○ | Existed |
| 119 | 93 | 5 | 2 | 496 | 841 | 19.8 | 16642 | 5 | 24 | x | Nil |
| 120 | 66 | 33 | 1 | 544 | 989 | 17.1 | 16947 | 16 | 0 | x | Nil |
| 121 | 83 | 4 | 13 | 554 | 1046 | 18.5 | 19313 | 4 | 53 | ○ | Nil |
| 122 | 74 | 20 | 6 | 459 | 917 | 27.5 | 25238 | 6 | 47 | x | Nil |
| 123 | 77 | 8 | 15 | 535 | 1189 | 16.0 | 19077 | 24 | 0 | x | Nil |
| 124 | 73 | 14 | 13 | 734 | 1129 | 18.5 | 20898 | 16 | 5 | ○ | Existed |
| 125 | 79 | 11 | 10 | 556 | 1183 | 15.4 | 18168 | 29 | 0 | ○ | Nil |
| 126 | 74 | 16 | 10 | 517 | 1099 | 19.7 | 21650 | 18 | 0 | ○ | Nil |
| 127 | 72 | 14 | 14 | 692 | 1099 | 17.4 | 19147 | 19 | 3 | ○ | Existed |
| 128 | 66 | 28 | 6 | 441 | 979 | 24.0 | 23457 | 7 | 29 | x | Existed |
| 129 | 68 | 25 | 7 | 474 | 1009 | 20.4 | 20555 | 5 | 16 | x | Existed |

*1 Number per 100 $\mu m^2$ of Mn—Si composite oxide having atom ratio (Mn/Si) of 0.5 or over and major axis of 0.01-5 μm

*2 Steel sheet surface covering ratio of oxide containing Si as main component

From Tables 1, 4, and 5, observations can be described as follows. (Nos. appearing below denote Experiment Nos.) Nos. 124 and 127 have satisfied the specific requirements as "the invention-related steel sheet 4" and have proven the excellent result in chemical conversion treatability and coating film adhesion. The related examples have shown it desirable that the manufacturing conditions in order to control the occurrence of cracks and secure excellent coating film adhesion, should give particular emphasis to the wind-up temperature and the cooling in the continuous annealing as preferred conditions No. 121 and 122 also have satisfied the specified requirements as "the invention-related steel sheet 5," and have been successful in obtaining an excellent steel sheet without crack and with good coating film adhesion. In order to secure chemical conversion treatability and enhance coating film adhesion further in the related examples, it will be preferred to control the component composition and make the shape of the oxide deposited on the surface of the steel sheet conform to the requirement.

Nos. 101-116, 123, 125, and 126 have satisfied the requirements as "the invention-related steel sheet 6" (that is, the requirements specified as "the invention-related steel sheet 4" and "the invention-related steel sheet 5" combined together), resulting that with the excellent chemical conversion treatability being secured and occurrence of cracks being controlled, the coating film adhesion is able to display excellent performance.

In contrast to the above, Nos. 117-120, 128, and 129 have not satisfied any of the requirements as "the invention-related steel sheets 4-6," with a result that the steel sheet is neither excellent in coating film adhesion, nor in strength-ductility balance, and furthermore, none of the steel sheet displays good performance in high strength coupled with ductility.

Nos. 117-120 have not satisfied the component composition defined in the present invention, proving to be inferior either in mechanical properties or in coating film adhesion. That is, No. 117 was insufficient in the amount of Si, and so was No. 120 in the combined amount of Si and Al, both the cases resulting in inferior strength-ductility balance. Also, No. 118 has been found containing excessive amount of Si and exceeding the upper limit of Si/Mn ratio, both the cases entailing the steel sheet surface nonconforming to the requirements and the coating film adhesion being inferior.

No. 119 has been found containing too small an amount of Mn to secure retained austenite sufficiently, causing inferior strength-ductility balance. Further, the Mn—Si composite oxide has not been secured enough as specified, resulting that the chemical conversion treatability has also become inferior.

Nos. 128 and 129 have not been manufactured according to the recommended conditions, nor in conformity with the shape of oxide specified in the present invention. For this reason, these steel sheets are inferior in the chemical conversion treatability and, due to cracks caused, in the coating film adhesion, too. As for No. 128, the acid pickling time has been too short to remove the concentrated Si layer. As for No. 129, the high dew point at the time of the continuous annealing enhances surface concentration of Si in the annealing process. Both the cases allow existence of a large amount of the oxide containing Si as the main component and also growth of Si oxide in the grain boundary. These have become the causes for the cracks occurring after acid pickling and for the inferior coating film adhesion.

Presented here for reference are the microgram of TEM observation showing the abstracted replica of the steel sheet obtained from the present embodiment and the photograph of SEM observation showing the surface of the steel sheet. FIG. 6 is a microgram of TEM observation of the surface of the steel sheet No. 118 as a comparative example. From this FIG. 6, it is clear that the surface layer region is covered with an oxide layer (the white-colored portion) containing Si as the main component.

FIG. 7 is a microgram of SEM observation of the surface of the steel sheet after chemical conversion treatment. It is obvious from this FIG. 7 that No. 118 has large clearances though zinc phosphate crystals are small.

In contrast to the above, FIG. 8 is a photograph of TEM observation of the surface of the steel sheet No. 107, an example of the present invention. In the surface layer region of the steel sheet, there is no such layer as is seen on the above No. 118, but there are particulate matters dispersed in a very fine state. In other words, it can be confirmed from FIG. 8 that in the surface layer region of the steel sheet No. 107, there is very little existence of oxide containing Si as the main component, which oxide works to deteriorate the chemical conversion treatability, but there exists a considerable amount of Mn—Si composite oxide which is effective for enhancing the chemical conversion treatability.

FIG. 9 is a microgram of SEM observation of the surface of the same steel sheet as above after chemical conversion treatment. From this FIG. 9, it is well perceived that No. 107 has few clearances with small zinc phosphate crystals,

EXAMPLE 4

Press work was applied to the steel sheet No. 107 (1.6 mm thick) in the above Example 3 to form a test piece in a shape of a hat channel simulating the center pillar reinforcement, one of automobile body structure components. Also, a test piece in the same shape was made of 1.8 mm thick comparative material according to JSC590Y by the standards of The Japan Iron and Steel Federation.

The test pieces were put to the three-point bending test in which the test pieces are held at both ends and given a load in the center by means of Amsler type testing machine, resulting that both the test pieces showed approximately equal load-displacement behaviors. From this result, it can be perceived that using the steel sheet according to the present invention for the manufacture of automobile body components will make thinner-walled structure possible and prove more effective in weight trimming of automobiles, than using the conventional steel sheet.

Figure 1:
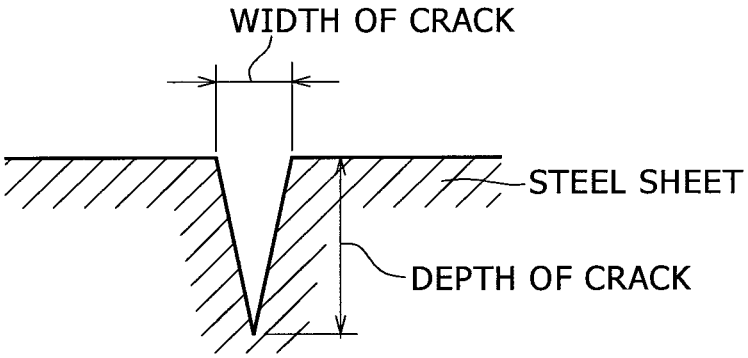
FIG. 1 is a schematic drawing showing a crack on a cross section of steel sheet
Figure 2:
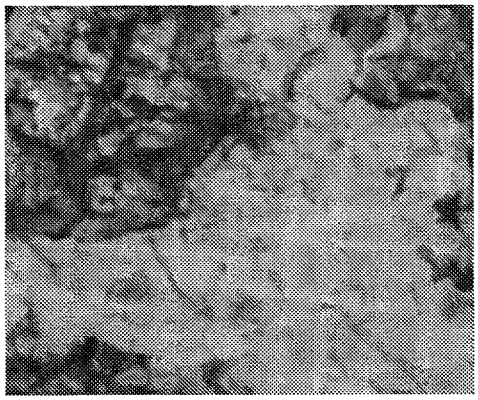
FIG. 2 is a TEM observation photograph (with abstracted replica; 1500 × magnification) of steel sheet No. 18 (comparative specimen) in Embodiment 1.
Figure 3:
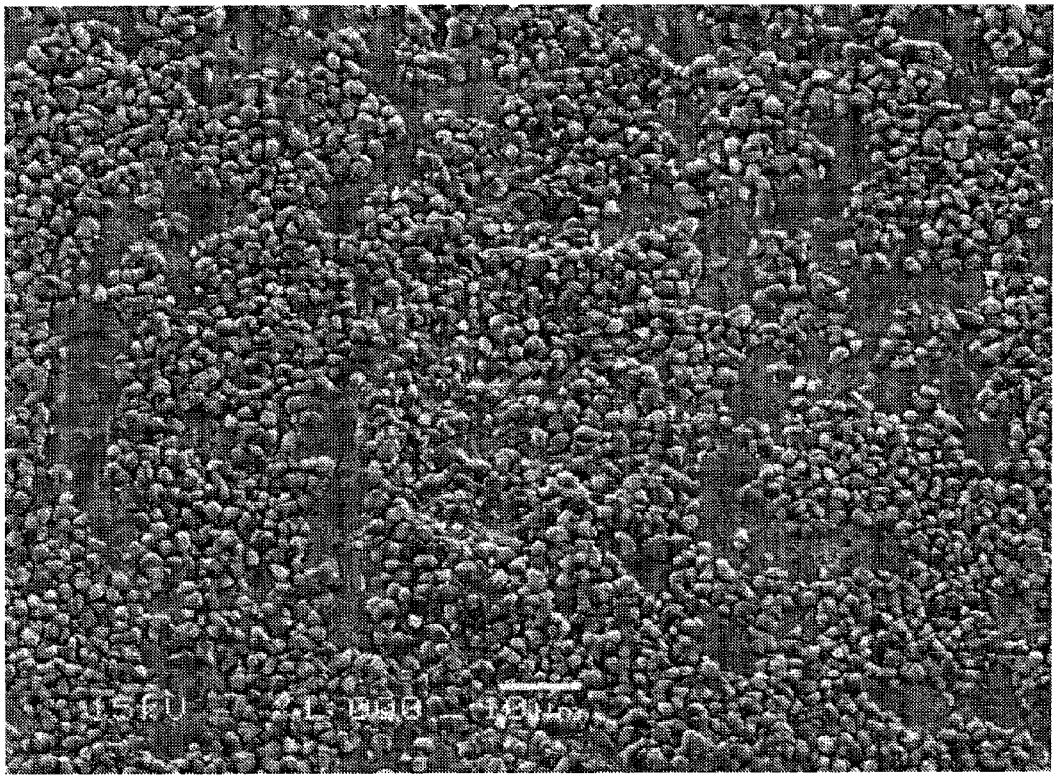
FIG. 3 is a SEM observation photograph of the surface (after chemical conversion treatment) of steel sheet No. 18 (comparative specimen) in Embodiment 1.
Figure 4:
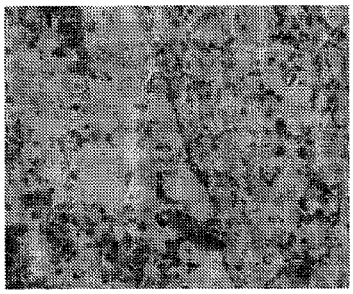
FIG. 4 is a TEM observation photograph (with abstracted replica; 15000× magnification) of steel sheet No. 7 (sample of the present invention) in Embodiment 1.
Figure 5:
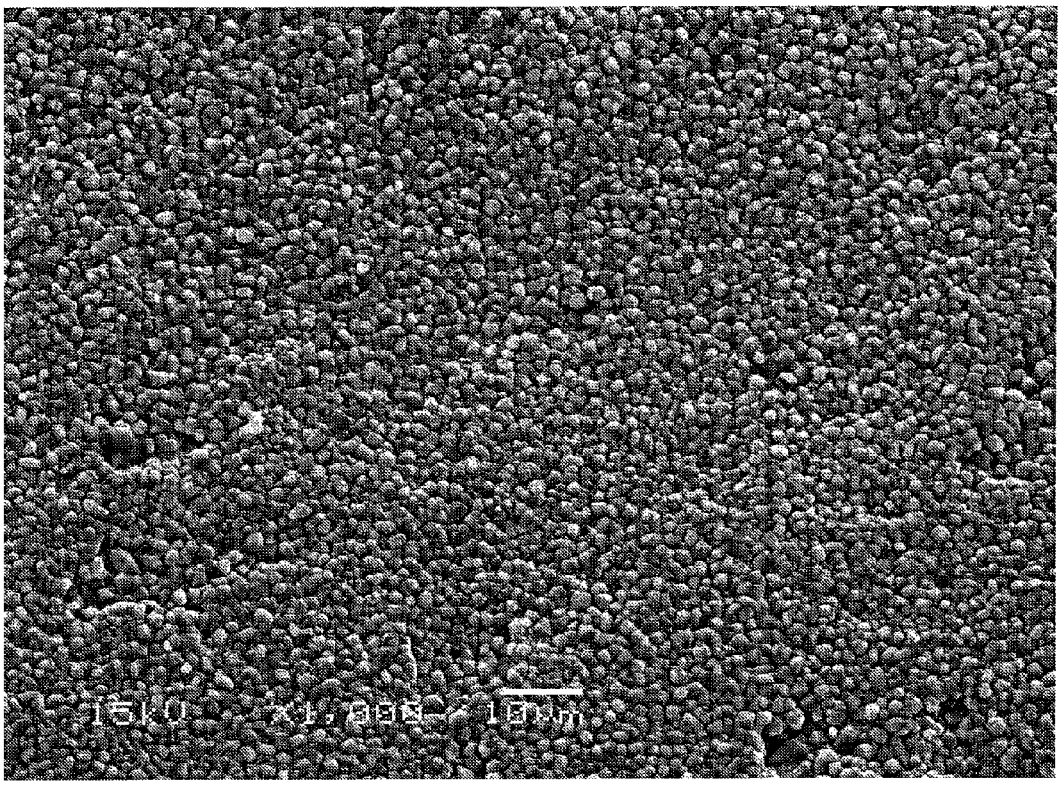
FIG. 5 is a SEM observation photograph of the surface (after chemical conversion treatment) of steel sheet No. 7 (sample of the present invention) in Embodiment 1.
Figure 6:
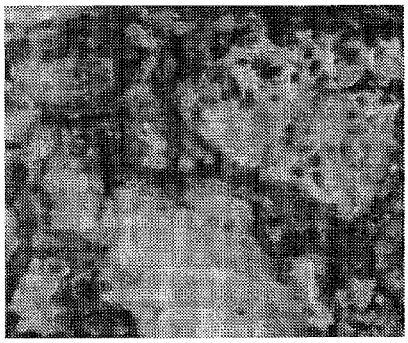
FIG. 6 is a TEM observation photograph (with abstracted replica; 15000× magnification) of steel sheet No. 118 (comparative specimen) in Embodiment 3.
Figure 7:
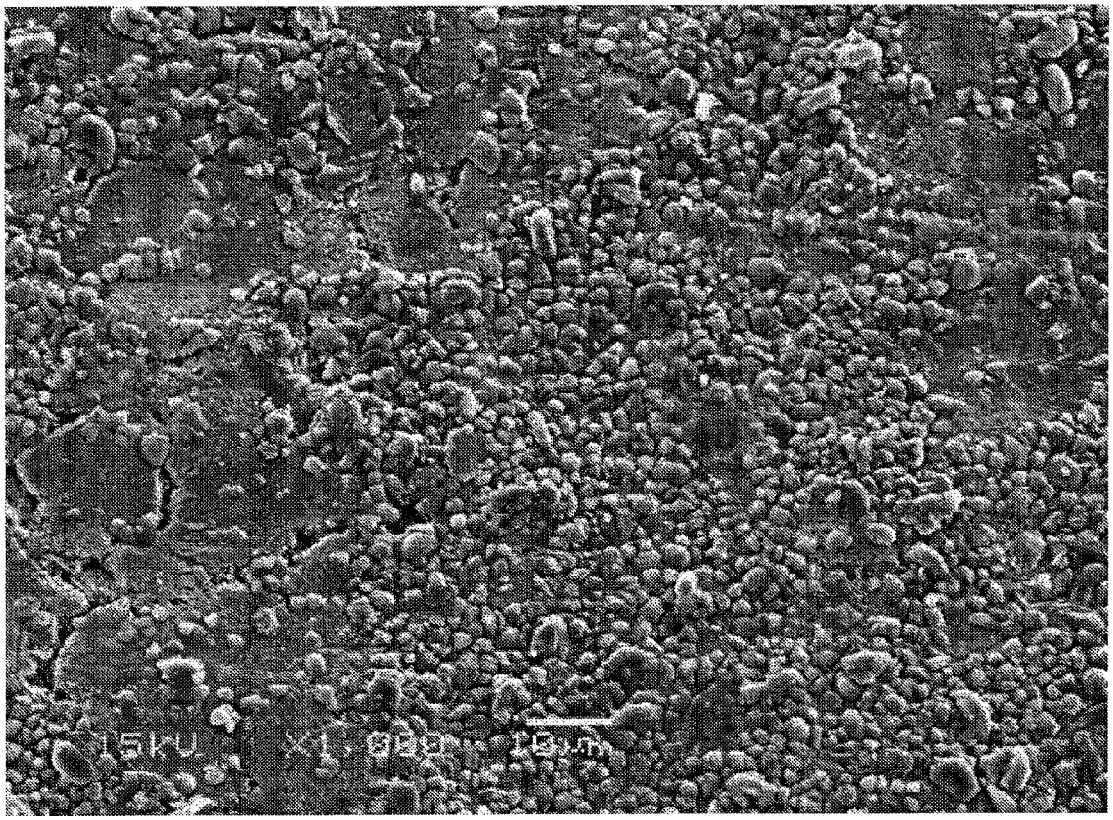
FIG. 7 is a SEM observation photograph of the surface (after chemical conversion treatment) of steel sheet No. 118 (comparative specimen) in Embodiment 3.
Figure 8:
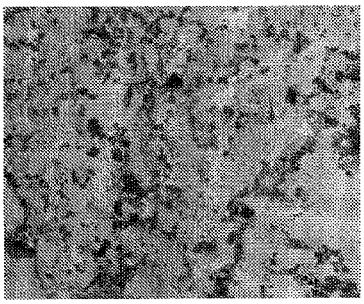
FIG. 8 is a TEM observation photograph (with abstracted replica; 15000× magnification) of steel sheet No. 107 (sample of the present invention) in Embodiment 3.
Figure 9:
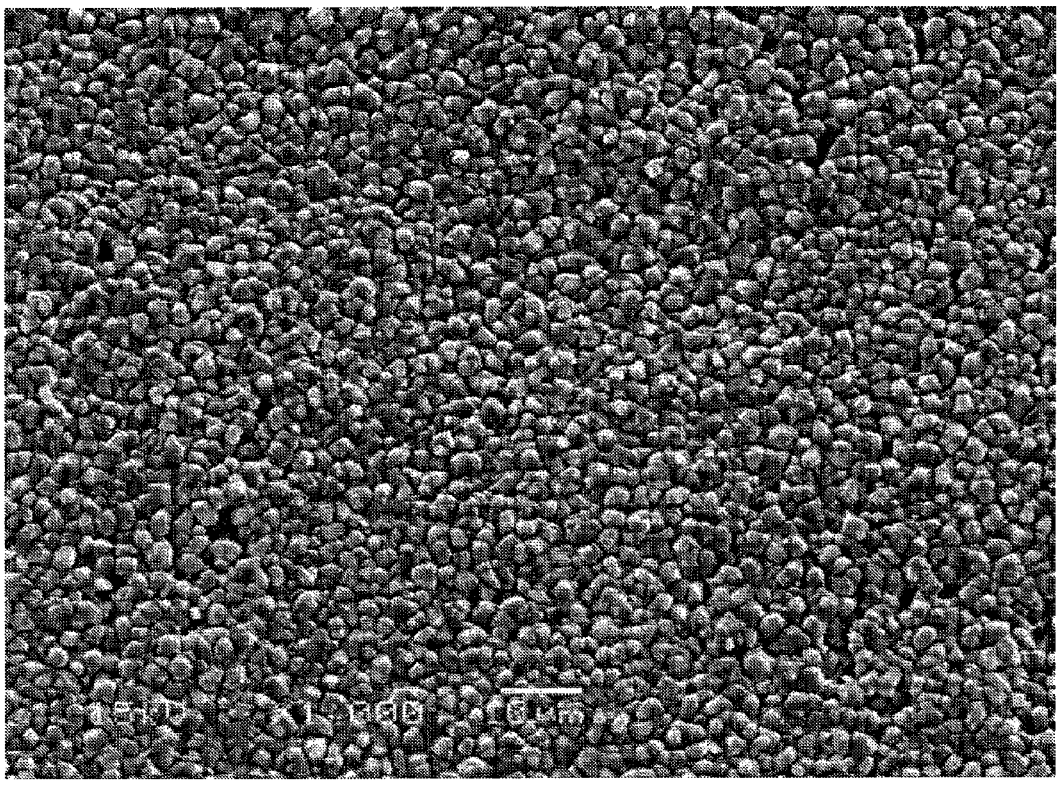
FIG. 9 is a SEM observation photograph of the surface (after chemical conversion treatment) of steel sheet No. 107 (sample of the present invention) in Embodiment 3.

The invention claimed is:

1. A cold rolled steel sheet wherein said cold rolled steel sheet has a chemical composition comprising, on the basis of percent by mass:

C ranging from 0.06 to 0.6%;

Si ranging from 0.1 to 2%;

Al ranging from 0.07 to 3%;

Si+Al ranging from 1 to 4%;

Mn ranging from 1 to 6%;

S of 0.02% or less;

N of 0.01% or less;

O of 0.01% or less; and the remainder being Fe and unavoidable impurities;

wherein:

Si/Mn≤0.40;

said cold rolled steel sheet has, in the surface of said steel sheet, 10 or more pieces/100 $\mu m^2$ of Mn—Si composite oxide of which a Mn—Si atom ratio (Mn/Si) is 0.5 or over and a major axis is from 0.01 μm to 5 μm, and has a covering ratio of 10% or below wherein the surface of said steel sheet is covered with oxide comprising Si as the main component; and said cold rolled steel sheet comprises, on the basis of the total volume fraction of the steel:

40% or over bainitic ferrite;

from 1 to 50% polygonal ferrite; and from 3% to 25% retained austenite, wherein a combined fraction of bainitic ferrite and polygonal ferrite is 75% or more and the tensile strength of the steel sheet is 780 MPa or higher.

2. A cold rolled steel sheet, wherein said cold rolled steel sheet has a chemical composition comprising, on the basis of percent by mass:

C ranging from 0.06 to 0.6%;

Si ranging from 0.1 to 2%;

Al ranging from 0.07 to 3%;

Si+Al ranging from 1 to 4%;

Mn ranging from 1 to 6%;

S of 0.02% or less;

N of 0.01% or less;

O of 0.01% or less; and the remainder being Fe and unavoidable impurities;

wherein: and

Si/Mn≤0.40;

said cold rolled steel sheet has in the surface of said steel sheet, 10 or more pieces/100 $\mu m^2$ of Mn—Si composite oxide of which a Mn—Si atom ratio (Mn/Si) is 0.5 or over and a major axis is from 0.01 μm to 5 μm, and has a covering ratio of 10% or below wherein the surface of said steel sheet is covered with oxide comprising Si as a main component; and said cold rolled steel sheet comprises, on the basis of the total volume fraction of the steel:

50% or over tempered martensite;
from 4 to 40% ferrite; and
from 3 to 25% retained austenite
wherein a combined fraction of tempered martensite and ferrite is 75% or more and the tensile strength of the steel sheet is 780 MPa or higher.

3. The cold rolled steel sheet according to claim 1, wherein said cold rolled steel sheet comprises no crack of 3 μm or less in width and 5 μm or over in depth in any 10 fields of view when observation at 2000× magnification by SEM is made of a cross section in the proximity of the surface of said steel sheet.

4. The cold rolled steel sheet according to claim 2, wherein said cold rolled steel sheet comprises no crack of 3 μm or less in width and 5 μm or over in depth in any 10 fields of view when observation at 2000× magnification by SEM is made of a cross section in the proximity of the surface of said steel sheet.

5. The cold rolled steel sheet according to claim 1, wherein said cold rolled steel sheet has a chemical composition comprising:
C ranging from 0.06 to 0.6%;
Si ranging from 0.1 to 2%;
Al ranging from 1.09 to 3%;
Si+Al ranging from 1 to 4%;
Mn ranging from 1 to 6%;
S of 0.02% or less;
N of 0.01% or less;
O of 0.01% or less; and
the remainder being Fe and unavoidable impurities;
wherein:
Si/Mn≤0.40;
said cold rolled steel sheet has in the surface of said steel sheet, 10 or more pieces/100 $\mu m^2$ of Mn—Si composite oxide of which a Mn—Si atom ratio (Mn/Si) is 0.5 or over and a major axis is from 0.01 μm to 5 μm, and further, has a covering ratio of 10% or below wherein the surface of said steel sheet is covered with oxide comprising Si as a main component; and
said cold rolled steel sheet comprises, on the basis of the total volume fraction of the steel:
40% or over bainitic ferrite;
from 1 to 50% polygonal ferrite; and
from 3% to 25% retained austenite,
wherein a combined fraction of bainitic ferrite and polygonal ferrite is 75% or more and the tensile strength of the steel sheet is 780 MPa or higher.

6. The cold rolled steel sheet according to claim 5, wherein said cold rolled steel sheet comprises no crack of 3 μm or less in width and 5 μm or over in depth in any 10 fields of view when observation at 2000× magnification by SEM is made of a cross section in the proximity of the surface of said steel sheet.

7. A steel component for an automobile, comprising the steel sheet according to claim 1.

8. A steel component for an automobile, comprising the steel sheet according to claim 2.

9. The cold rolled steel sheet according to claim 1,
wherein said cold rolled steel sheet has a chemical composition comprising, on the basis of percent by mass:
C ranging from 0.06 to 0.6%;
Si ranging from 0.1 to 2%;
Al ranging from 0.2 to 3%;
Si+Al ranging from 1 to 4%;
Mn ranging from 1 to 6%;
S of 0.02% or less;
N of 0.01% or less;
O of 0.01% or less; and
the remainder being Fe and unavoidable impurities;
wherein:
Si/Mn≤0.40;
said cold rolled steel sheet has in the surface of said steel sheet, 10 or more pieces/100 $\mu m^2$ of Mn—Si composite oxide of which a Mn—Si atom ratio (Mn/Si) is 0.5 or over and a major axis is from 0.01 μm to 5 μm, and further, has a covering ratio of 10% or below wherein the surface of said steel sheet is covered with oxide comprising Si as a main component; and
said cold rolled steel sheet has a microstructure comprising, on the basis of the total volume fraction of the microstructure:
67% or over bainitic ferrite;
from 1 to 26% polygonal ferrite; and
3% to 25% retained austenite,
wherein a combined fraction of bainitic ferrite and polygonal ferrite is 75% or more and the tensile strength of the steel sheet is 780 MPa or higher.

10. The cold rolled steel sheet according to claim 2,
wherein said cold rolled steel sheet has a chemical composition comprising, on the basis of percent by mass:
C ranging from 0.06 to 0.6%;
Si ranging from 0.1 to 2%;
Al ranging from 1.09 to 3%;
Si+Al ranging from 1 to 4%;
Mn ranging from 1 to 6%;
S of 0.02% or less;
N of 0.01% or less;
O of 0.01% or less; and
the remainder being Fe and unavoidable impurities;
wherein:
Si/Mn≤0.40,
said cold rolled steel sheet has in the surface of said steel sheet, 10 or more pieces/100 $\mu m^2$ of Mn—Si composite oxide of which a Mn—Si atom ratio (Mn/Si) is 0.5 or over and a major axis is from 0.01 μm to 5 μm, and further, has a covering ratio of 10% or below wherein the surface of said steel sheet is covered with oxide comprising Si as a main component; and
said cold rolled steel sheet comprises, on the basis of the total volume fraction of the steel:
50% or over tempered martensite;
from 4 to 40% ferrite; and
from 6% to 25% retained austenite
wherein a combined fraction of tempered martensite and ferrite is 75% or more and the tensile strength of the steel sheet is 780 MPa or higher.

11. The cold rolled steel according to claim 1, wherein the microstructure of the steel comprises 50% or higher of bainitic ferrite on the basis of the total volume fraction of the microstructure.

12. The cold rolled steel according to claim 1, wherein the Si content is in a range of 0.5% to 2%.

13. The cold rolled steel according to claim 1, wherein the Al content is in a range of 0.2% to 3%.

14. The cold rolled steel according to claim 2, wherein the Al content is in a range of 1.12 to 3%.

15. A cold rolled steel sheet, wherein
said cold rolled steel sheet has a chemical composition comprising, on the basis of percent by mass:
C ranging from 0.06 to 0.6%;
Si ranging from 0.1 to 2%;
Al ranging from 0.07 to 3%;
Si+Al ranging from 1 to 4%;
Mn ranging from 1 to 6%;

S of 0.02% or less;
N of 0.01% or less;
O of 0.01% or less; and
the remainder being Fe and unavoidable impurities;
wherein:
Si/Mn≤0.40;
said cold rolled steel sheet comprises, on the basis of the total volume fraction of the steel:
40% or over bainitic ferrite;
from 1 to 50% polygonal ferrite; and
from 3% to 25% retained austenite,
wherein a combined fraction of bainitic ferrite and polygonal ferrite is 75% or more, the tensile strength of the steel sheet is 780 MPa or higher; and there exists no crack of 3 μm or less in width and 5 μm or over in depth in any 10 fields of view when observation at 2000× magnification by SEM is made of a cross section in the proximity of the surface of said steel sheet.

16. A cold rolled steel sheet, wherein
said cold rolled steel sheet has a chemical composition comprising, on the basis of percent by mass:
C ranging from 0.06 to 0.6%;
Si ranging from 0.1 to 2%;
Al ranging from 0.07 to 3%;
Si+Al ranging from 1 to 4%;
Mn ranging from 1 to 6%;
S of 0.02% or less;
N of 0.01% or less;
O of 0.01% or less; and
the remainder being Fe and unavoidable impurities;
wherein:
Si/Mn≤0.40;
said cold rolled steel sheet comprises, on the basis of the total volume fraction of the steel:
50% or over tempered martensite;
from 4 to 40% ferrite; and
from 3 to 25% retained austenite;
wherein a combined fraction of tempered martensite and ferrite is 75% or more, the tensile strength of the steel sheet is 780 MPa or higher; and there exists no crack of 3 μm or less in width and 5 μm or over in depth in any 10 fields of view when observation at 2000× magnification by SEM is made of a cross section in the proximity of the surface of said steel sheet.

17. The cold rolled steel sheet according to claim 1, wherein a metal structure of said cold rolled steel sheet consists of, on the basis of the total volume fraction of the metal structure of the steel:
40% or over bainitic ferrite;
from 1 to 50% polygonal ferrite; and
from 3% to 25% retained austenite,
wherein a combined fraction of bainitic ferrite and polygonal ferrite is 75% or more.

18. The cold rolled steel sheet according to claim 15, wherein a metal structure of said cold rolled steel sheet consists of, on the basis of the total volume fraction of the metal structure of the steel:
40% or over bainitic ferrite;
from 1 to 50% polygonal ferrite; and
from 3% to 25% retained austenite,
wherein a combined fraction of bainitic ferrite and polygonal ferrite is 75% or more.

19. The cold rolled steel sheet according to claim 15, comprising, on the basis of percent by mass: Al ranging from 0.07 to 3%.

20. The cold rolled steel sheet according to claim 2, comprising, on the basis of percent by mass: Si ranging from 1.03 to 2%.

21. The cold rolled steel sheet according to claim 16, comprising, on the basis of percent by mass: Si ranging from 1.03 to 2%.

22. The cold rolled steel sheet according to claim 1, wherein the cold rolled steel sheet is obtained by a process comprising suppressing a dew point during continuous annealing at −40° C. or less.

23. The cold rolled steel sheet according to claim 2, wherein the cold rolled steel sheet is obtained by a process comprising suppressing a dew point during continuous annealing at −40° C. or less.

24. The cold rolled steel sheet according to claim 15, wherein the cold rolled steel sheet is obtained by a process comprising suppressing a dew point during continuous annealing at −40° C. or less.

25. The cold rolled steel sheet according to claim 16, wherein the cold rolled steel sheet is obtained by a process comprising suppressing a dew point during continuous annealing at −40° C. or less.

26. The cold rolled steel sheet according to claim 1, wherein the cold rolled steel sheet is obtained by a process comprising suppressing a dew point during continuous annealing at less than −50° C.

27. The cold rolled steel sheet according to claim 1, wherein the cold rolled steel sheet is obtained by a process comprising immersing a hot rolled sheet having the composition of claim 1 in hydrochloric acid for 40 seconds or over at a temperature of from 70 to 90° C.

28. The cold rolled steel sheet according to claim 2, wherein the cold rolled steel sheet is obtained by a process comprising immersing a hot rolled sheet having the composition of claim 2 in hydrochloric acid for 40 seconds or over at a temperature of from 70 to 90° C.

29. The cold rolled steel sheet according to claim 16, wherein the cold rolled steel sheet is obtained by a process comprising immersing a hot rolled sheet having the composition of claim 21 in hydrochloric acid for 40 seconds or over at a temperature of from 70 to 90° C.

* * * * *